US011027449B2

(12) United States Patent
Schroll et al.

(10) Patent No.: US 11,027,449 B2
(45) Date of Patent: Jun. 8, 2021

(54) METHODS AND APPARATUS FOR CUTTING CUSHIONED DIVIDER MATERIAL FOR USE IN CREATING SUB-COMPARTMENTS IN A CONTAINER

(71) Applicant: TrekPak, LLC, Broomfield, CO (US)

(72) Inventors: Gregory Schroll, Denver, CO (US); Jared Brown, Arvada, CO (US)

(73) Assignee: TrekPak, LLC, Broomfield, CO (US)

( * ) Notice: Subject to any disclaimer, the term of this patent is extended or adjusted under 35 U.S.C. 154(b) by 264 days.

(21) Appl. No.: 15/900,545

(22) Filed: Feb. 20, 2018

(65) Prior Publication Data

US 2019/0184591 A1 Jun. 20, 2019

Related U.S. Application Data

(60) Provisional application No. 62/598,560, filed on Dec. 14, 2017.

(51) Int. Cl.
*B26D 3/00* (2006.01)
*B26D 1/06* (2006.01)
(Continued)

(52) U.S. Cl.
CPC ..... *B26D 3/006* (2013.01); *B24B 21/00* (2013.01); *B24B 27/06* (2013.01); *B26B 5/005* (2013.01); *B26B 5/006* (2013.01); *B26B 5/008* (2013.01); *B26D 1/02* (2013.01); *B26D 1/03* (2013.01); *B26D 1/065* (2013.01); *B26D 5/005* (2013.01); *B26D 7/015* (2013.01); *B26D 7/18* (2013.01); *B26D 2001/006* (2013.01)

(58) Field of Classification Search
None
See application file for complete search history.

(56) References Cited

U.S. PATENT DOCUMENTS 181,918 A 9/1876 Cushing
663,134 A 12/1900 Simon
(Continued)

OTHER PUBLICATIONS

U.S. Appl. No. 62/598,560, filed Dec. 14, 2017. First Named Inventor: Schroll.

(Continued)

*Primary Examiner* — Peter L Vajda
*Assistant Examiner* — Adrianna N Konves
(74) *Attorney, Agent, or Firm* — Santangelo Law Offices, P.C.

(57) ABSTRACT

Particular embodiments of the inventive technology relate to apparatus and methods for cutting multi-layered material to reconfigure it so it may be used to construct sub-compartments in a larger storage container. The inventive technology, in particular embodiments may feature one or more of the following: dual blades, "staggered" blades (where one blade is more forward than another), a blade(s) angled upwards and forwards, blades separated in a left-right direction, prong recesses to accept trailing tips of blades, a rearwardly angled handle and/or a removed material ejection ramp, in conjunction perhaps with other features such as, e.g., a guide prong. One or more of such features may appear in the various manifestations of a defluting cutter or through cutting apparatus, whether guided or unguided, and/or manual or powered.

18 Claims, 38 Drawing Sheets

(51) Int. Cl.

| | |
|---|---|
| ***B26B 5/00*** | (2006.01) |
| ***B26D 7/01*** | (2006.01) |
| ***B26D 1/02*** | (2006.01) |
| ***B24B 21/00*** | (2006.01) |
| ***B26D 5/00*** | (2006.01) |
| ***B26D 1/03*** | (2006.01) |
| ***B26D 7/18*** | (2006.01) |
| ***B24B 27/06*** | (2006.01) |
| *B26D 1/00* | (2006.01) |

(56) References Cited

U.S. PATENT DOCUMENTS

| | | | |
|---|---|---|---|
| 869,833 | A | 10/1907 | Ferres |
| 920,409 | A | 5/1909 | Wild |
| 1,061,531 | A | 5/1913 | Emmons |
| 1,261,954 | A | 4/1918 | Newman |
| 1,431,764 | A | 10/1922 | Steeples |
| 1,757,073 | A | 5/1930 | Boyle |
| 2,279,833 | A | 4/1942 | Madan |
| 2,607,972 | A | 8/1952 | Rust |
| 2,958,943 | A | 11/1960 | Koe |
| D191,277 | S | 9/1961 | Uttz |
| 3,543,400 | A | 12/1970 | Scott et al. |
| 3,731,572 | A | 5/1973 | Crooks |
| 3,904,066 | A | 9/1975 | Wilson |
| 4,031,616 | A | 6/1977 | Hines et al. |
| 4,164,313 | A | 8/1979 | Hewitt |
| D254,243 | S | 2/1980 | Florian et al. |
| 4,197,775 | A | 4/1980 | Handler et al. |
| D260,358 | S | 8/1981 | Wilson et al. |
| 4,355,537 | A | 10/1982 | vander Have |
| 4,434,824 | A | 3/1984 | Bussey |
| 4,457,070 | A | 7/1984 | Reeves |
| 4,463,895 | A | 8/1984 | Pasquale |
| 4,503,612 | A | 3/1985 | Davis |
| 4,507,867 | A | 4/1985 | Haas, Jr. |
| 4,776,481 | A | 10/1988 | Kidd |
| 4,787,553 | A | 11/1988 | Hoskins |
| 4,995,288 | A | 2/1991 | DellaPolla |
| 5,080,152 | A | 1/1992 | Collins et al. |
| 5,127,162 | A | 7/1992 | Mansfield |
| 5,273,090 | A | 12/1993 | Klemma |
| 5,394,781 | A | 3/1995 | Tsubai |
| 5,411,510 | A | 5/1995 | Fugo |
| 5,427,006 | A | 6/1995 | Finley |
| 5,442,984 | A | 8/1995 | Tate |
| 5,484,078 | A | 1/1996 | Bronovicki |
| 5,561,905 | A | 10/1996 | Sherman |
| 5,568,688 | A | 10/1996 | Andrews |
| 5,581,887 | A | 12/1996 | Woodring |
| 5,581,889 | A | 12/1996 | Reuter |
| 5,638,983 | A | 6/1997 | Bazany |
| 5,647,420 | A | 7/1997 | Michell |
| 5,651,298 | A | 7/1997 | Break et al. |
| D381,886 | S | 8/1997 | Domenico |
| 5,664,612 | A | 9/1997 | Klemma |
| 5,697,157 | A | 12/1997 | Votolato |
| 5,737,842 | A | 4/1998 | Freedman |
| 5,758,423 | A | 6/1998 | Eversole et al. |
| 5,765,288 | A | 6/1998 | Hagler, Jr. |
| 5,768,967 | A | 6/1998 | Sasaki et al. |
| 5,853,239 | A | 12/1998 | Laib et al. |
| 5,868,054 | A | 2/1999 | Chubb et al. |
| 5,890,290 | A | 4/1999 | Davis |
| 5,907,917 | A * | 6/1999 | Bicker ..... B26B 5/008 40/1 |
| 5,921,161 | A | 7/1999 | Newell |
| 6,070,696 | A | 6/2000 | Chubb et al. |
| 6,079,309 | A | 6/2000 | Molburg |
| 6,195,896 | B1 | 3/2001 | Ireland |
| 6,493,917 | B1 | 12/2002 | Sunka |
| 6,505,403 | B1 | 1/2003 | Andrews |
| D470,030 | S | 2/2003 | Swier |
| 6,513,249 | B2 | 2/2003 | Linton et al. |
| 6,578,243 | B1 | 6/2003 | Hall |
| 6,578,266 | B2 | 6/2003 | Chomiak |
| 6,637,705 | B2 | 10/2003 | Sjoblom et al. |
| D501,126 | S | 1/2005 | Addis |
| 6,928,711 | B1 | 8/2005 | Sunka |
| 6,938,345 | B2 | 9/2005 | Yu |
| 7,063,000 | B2 | 6/2006 | Molburg |
| 7,124,992 | B1 | 10/2006 | Colledge |
| D540,647 | S | 4/2007 | Ireland |
| 7,353,606 | B2 | 4/2008 | Hudgins |
| D586,197 | S | 2/2009 | Della Polla |
| 7,533,595 | B2 | 5/2009 | Domenico |
| 7,540,094 | B2 | 6/2009 | Okada |
| 7,621,206 | B2 | 11/2009 | Makropoulos |
| 7,757,592 | B2 | 7/2010 | Wilson |
| 7,870,675 | B1 | 1/2011 | DellaPolla |
| D631,724 | S | 2/2011 | Della Polla |
| 8,201,483 | B2 | 6/2012 | Wilson |
| 8,443,518 | B2 | 5/2013 | Fisher |
| 8,555,762 | B1 | 10/2013 | Jones |
| 8,561,305 | B2 | 10/2013 | Davis et al. |
| 8,782,909 | B1 | 7/2014 | Davis et al. |
| 8,967,607 | B2 | 3/2015 | Ducek |
| 9,266,249 | B1 | 2/2016 | Moore |
| 9,346,483 | B2 | 5/2016 | Davis et al. |
| 9,650,065 | B2 | 5/2017 | Davis |
| 9,669,538 | B2 | 6/2017 | Iannelli |
| D791,060 | S | 7/2017 | Bartish et al. |
| 2002/0078572 | A1 | 6/2002 | Linton et al. |
| 2002/0194734 | A1 | 12/2002 | Huang |
| 2004/0025352 | A1 | 2/2004 | Vitucci |
| 2005/0235500 | A1 | 10/2005 | Domenico |
| 2006/0288587 | A1 | 12/2006 | Ireland |
| 2007/0175049 | A1 | 8/2007 | Goode et al. |
| 2007/0245572 | A1* | 10/2007 | Ireland ..... B26B 27/005 30/294 |
| 2008/0016702 | A1 | 1/2008 | Domenico |
| 2010/0154219 | A1 | 6/2010 | Huett |
| 2016/0008991 | A1* | 1/2016 | Peppett ..... B26B 29/06 30/280 |
| 2017/0239824 | A1* | 8/2017 | Spencer, Jr. ..... B26B 29/06 |

OTHER PUBLICATIONS

TrekPak,"Multi Purpose Cutter Tool". http://trekpak.com/multi-purpose-cutter-tool/. Retrieved Feb. 20, 2018. 1 page.

FastCap, "SafeCut Mouse", www.fastcap.com/estore. Retrieved Dec. 14, 2017. 2 pages.

Pelican, "Clean Up Your Act" Pelican + TrekPak. (c) 2016. 7 pages.

* cited by examiner

METHODS AND APPARATUS FOR CUTTING CUSHIONED DIVIDER MATERIAL FOR USE IN CREATING SUB-COMPARTMENTS IN A CONTAINER

CROSS-REFERENCE TO RELATED APPLICATIONS

This US Nonprovisional application claims priority to and the benefit of U.S. Provisional Application No. 62/598,560, filed Dec. 14, 2017, said provisional application incorporated by reference herein in its entirety.

BACKGROUND

The desire to create sub-compartments 1 in a larger container/compartment 2 using divider material, and to cushion such sub-compartments using that same material, has been known for some time. For example, photographers may prefer a closeable case for storage and transport of lenses, camera body, etc., that presents several smaller storage areas instead of one larger storage area. A photographer may store, e.g., a separate piece of photographic equipment, in each of such smaller, typically cushioned, storage areas (sub-compartments) having sidewalls that are made of such board material after such is cut to an appropriate size (see, e.g., FIG. 1), thereby protecting such equipment from damage sustained during impact (e.g., between different pieces of equipment) or due to contact rubbing. Sub-compartments may be custom-sized using cushioned divider material so that they are small enough to prevent an unacceptable degree of motion of the contained piece of equipment (to which they may be dedicated) relative to inner surfaces of the divider material and container, but of course large enough so that such equipment can be easily fit in that sub-compartment. "U"-shaped pins inserted into flutes of different, perhaps abutting segments of divider material may be used to hold, e.g., perpendicular segments (e.g., walls) of the divider material in substantially fixed position relative to each other (see FIG. 1). Of course, the inventive technology is not limited to the use of sub-compartments for photographic material, as indeed, many different types of equipment, material, items, etc., can be stored in such sub-compartments.

One type of divider material that has found favor with consumers, and photographers in particular, is foam fluted board 4, which is a multi-layer material with a fluted board core 5 sandwiched by upper and lower foam layers 6, 7. One reason for its popularity is that such divider material can be readily cut to a custom size by a customer with an inexpensive handheld tool to create sub-compartments of a larger storage case that are each uniquely sized to snugly accommodate a certain piece of equipment. Another reason for its popularity is the "appropriateness" of the degree of cushioning it provides—soft enough (as provided by the foam layers) to prevent scuffing and absorb small impacts, but firm enough to prevent damage in the event of some larger impacts (e.g., where an entire closed case is dropped from a height).

The outer, "softer" layers 6, 7 of the divider material may be, e.g., any of a variety of types of foam or other cushion layer; the inner layer 5 may be a fluted (corrugated) board made of, e.g., polypropylene, as but one example. The flute 8 is the channel; flute walls 9, 10 (and flute floor 11 and flute ceiling 12) form and are part of that channel. The flute floor and ceiling are typically, but not necessarily, the same material as the left 10 and right 9 walls, or may merely be the upper surface of the foam below the center layer, and the lower surface of the foam above the center layer, respectively.

Generally, the inventive technology disclosed herein relates primarily to two cutter apparatus—a defluting cutter 15, and a through-cutter 16—and associated methods. Both present advantages relative to other methods of cutting the divider material. For example, one experimental method involving lasers melted foam, leaving an unacceptable edge; another method involving a rotating saw blade left unacceptably rough edges. The inventive technology disclosed herein, however, leaves a clean, accurate cut, among offering other advantages.

BRIEF DESCRIPTION OF THE FIGURES

The figures show only examples of the many different possible embodiments and variations of the inventive technology and related components/parts/materials.

FIG. 2 shows a board to be cut by a manual, moving blade cutter (defluter or through-cutter) from the rear.

DESCRIPTION OF THE PREFERRED EMBODIMENTS

Figure 1:
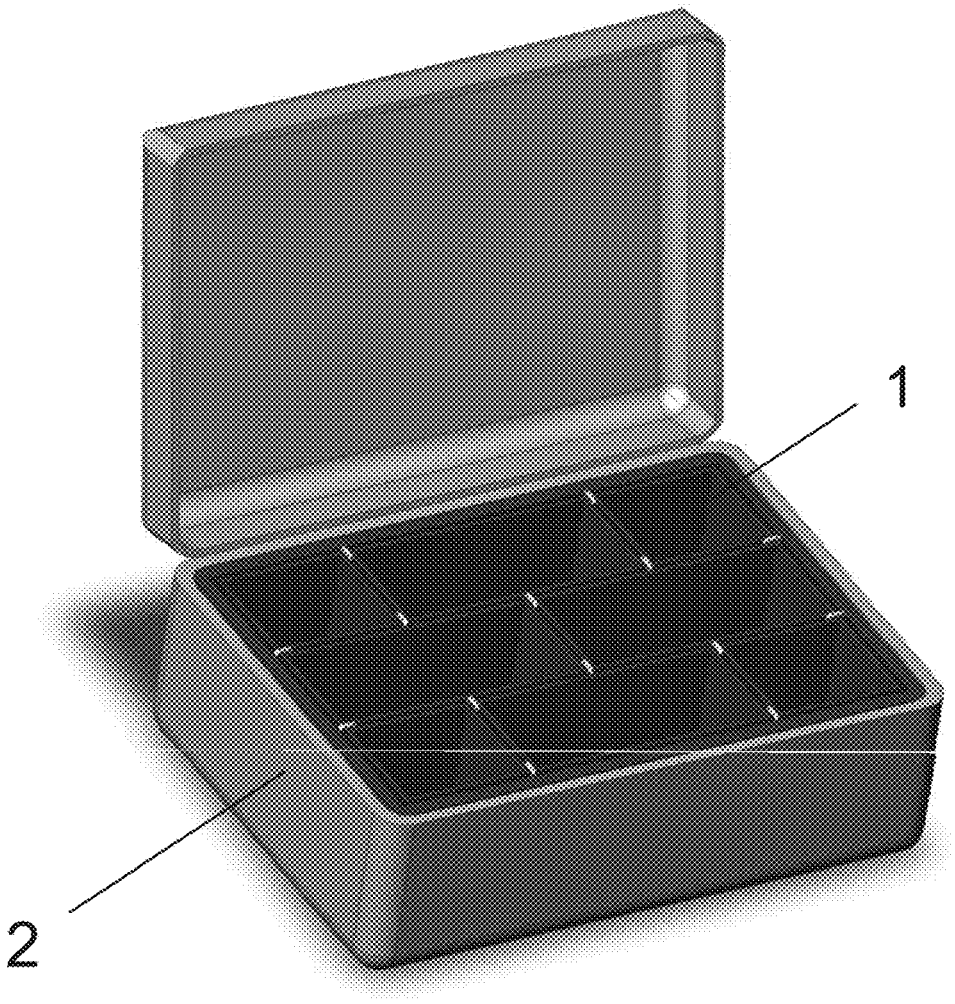
FIG. 1 shows a perspective view of divider material established in an open container to create sub-compartments in that container.
Figure 2:
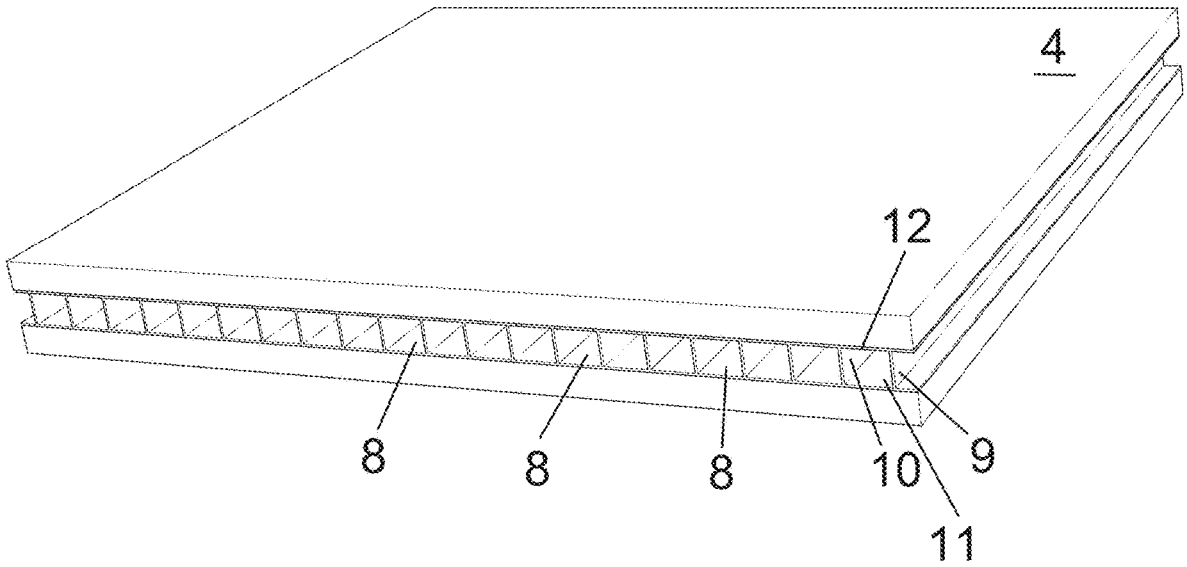
FIG. 2 shows a perspective view of a foam fluted board, with through cuts on the left and right sides, and the fronts of flutes showing along the front edge.
Figure 3:
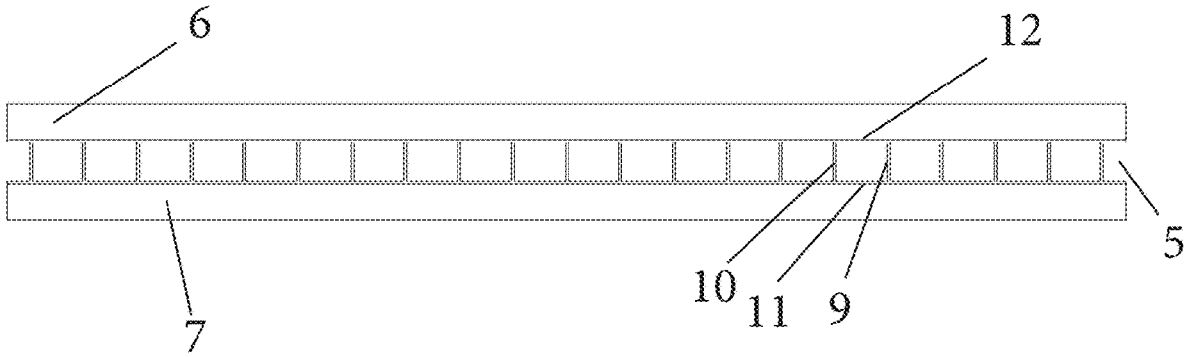
FIG. 3 shows a view from behind of a foam fluted board (to be cut by, e.g., a defluter), and right and left flute walls, and flute ceilings and floors.
Figure 4:
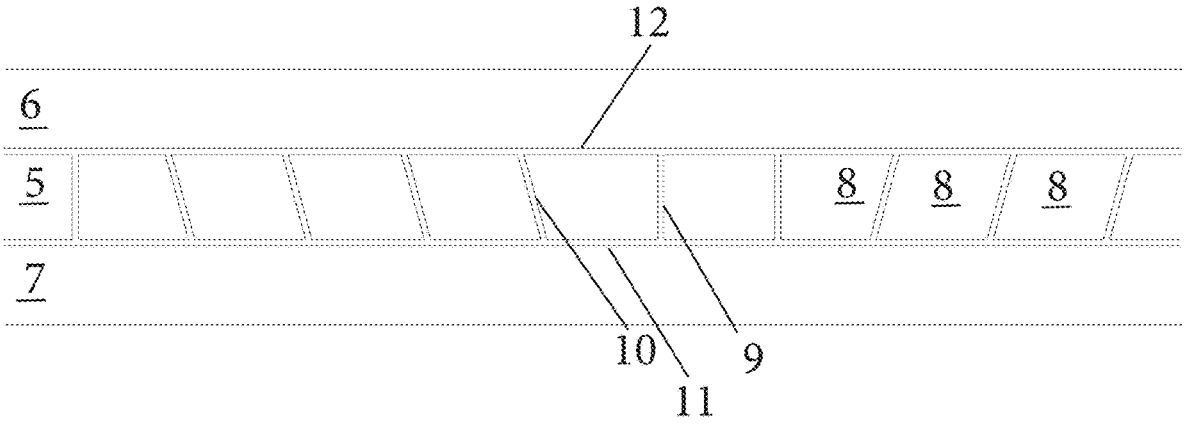
FIG. 4 shows a foam fluted board from behind with off-vertical right and left flute walls.
Figure 5:
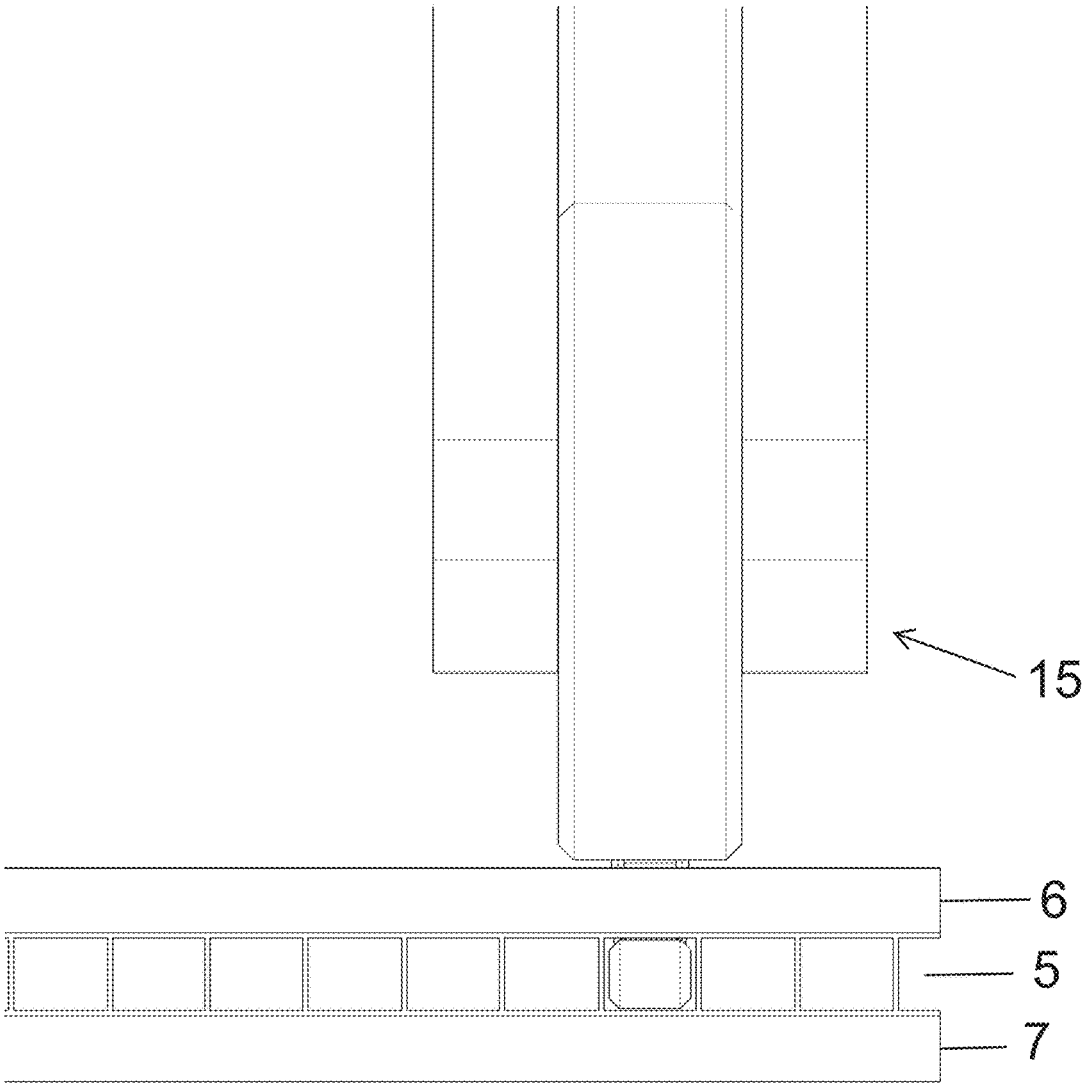
FIG. 5 shows a front view of a defluting cutter established in a flute during a cut.

As mentioned earlier, the present invention includes a variety of aspects, which may be combined in different ways. The following descriptions are provided to list elements and describe some of the embodiments of the present invention. These elements are listed with initial embodiments; however, it should be understood that they may be combined in any manner and in any number to create additional embodiments. The variously described examples and preferred embodiments should not be construed to limit the present invention to only the explicitly described systems, techniques, and applications. The specific embodiment or embodiments shown are examples only. The specification should be understood and is intended as supporting broad claims as well as each embodiment, and even claims where other embodiments may be excluded. Importantly, disclosure of merely exemplary embodiments are not meant to limit the breadth of other more encompassing claims that may be made where such may be only one of several methods or embodiments which could be employed in a broader claim or the like. Further, this description should be understood to support and encompass descriptions and claims of all the various embodiments, systems, techniques, methods, devices, and applications with any number of the disclosed elements, with each element alone, and also with any and all various permutations and combinations of all elements in this or any subsequent application.

Generally, the two inventive cutters, both cutter apparatus, are: (1) a defluting cutter 15 (a "defluter"); and (2) a through-cutter 16. Each cutter may be (or may be part of) a moving blade tool (where the blade (and other components) is moved relative to a stationary workpiece) or instead a moving workpiece tool (where the workpiece, e.g., the divider material such as foam fluted board, is moved relative to a substantially stationary blade). Regardless, each cutter is usable to reconfigure, via cutting, material such as but not limited to foam fluted board.

During operation of the defluting cutter, a person (e.g., in position to cut the board) stands such that that person's sagittal axis is parallel with the longitudinal axes of the flutes. Indeed, such is a cutting position with particular embodiments of the handheld cutter that is moved manually relative to the board (moving blade cutter/tool) and even in particular embodiments of the moving workpiece cutter/tool (in manner analogous to operation of a table saw). In such positioning of the board (during a cut by, e.g., such manual tool), the channels repeat in a left and right direction relative to that person (standing in front of the board).

Note that left, right, up, down, front and rear as used with respect to a cutter presumes a board placed flat on a table, whether the cutter is part of a moving blade tool or a moving workpiece tool. The first part of the blade(s) to cut the material during operation defines a forward direction; the front part of the cutter is consistent with that forward direction and is more forward than the rear part of the tool. Right and left are defined from a perspective of a viewer above the cutter in its position during operation, looking down on it, in a forward direction. The rear of the cutter is the portion on the opposite side from the front of the cutter. Right, left, front, rear, top, bottom, above, below, as used herein presumes a cutter in operating position (e.g., if it is a movable cutter, then the cutter is likely prong down; if it is a movable workpiece cutter, then the cutter is likely prong up). The same convention is used with respect to a workpiece (foam fluted board), e.g., right and forward on a board are the same as a cutter that is in position to cut that board.

The defluting cutter may be a tool by itself, e.g., as where the cutter is an unguided manual defluter; the through-cutter may be a tool by itself, e.g., as where the cutter is an unguided manual through-cutter. However, the guided, manual (or powered) moving blade defluting cutter may be part of a larger, guided, manual (or powered) moving blade defluting tool that includes guides, e.g., a fence, stops and/or template (and, for powered versions, that includes components that move the workpiece or the cutter). The same applies to the through-cutter.

Each cutter may be a manual cutter (for manual operation by a human user, where the force that moves the cutter or workpiece during a cut is applied by a human person), or powered (where the force that moves the cutter or workpiece during a cut is applied by something other than a human, e.g., a machine (whether electric or otherwise)). Any cutter may be guided (e.g., with fences, templates, guides, stops, outrigging, etc.), which includes partially guided, or unguided (typically only manual tool versions would be unguided). A partially guided cutter (and its tool) may be where, e.g., the cutter is guided by a fence so the cut is along a straight line, but allows for tilt (in "roll" direction) during a cut. Accordingly, and by example only, one type of cutter is a manual, unguided, moving blade defluter cutter. Another would be a manual, guided, moving workpiece defluting cutter. Yet another would be a powered, guided, moving blade through-cutter. Such terminology also applies to the tool itself (not just the cutter), which generally relates to the entirety of the components (including at the least the cutter) that are used to generate a defluting cut or a through cut. Note that certain embodiments of the inventive technology may involve a entirely automated cutter tool (e.g., powered, and fully guided).

Some guided, moving blade tools, whether manual or powered, include not only the cutter, but also other components that enable the guided movement of the blade (e.g., fences, templates, stops, etc.), and perhaps components that enable the proper securement (positioning) of the workpiece (bracing). Some moving workpiece tools, like certain blade-in-table tools, may, in manner similar to that seen in well known table saws, include not only the cutter, but also the table and any fencing. But where there is no fencing or other guide, or where a guides is simply an add-on jig that is disconnected from the cutter, the manual tool—whether the defluter or the through-cutter—is simply the cutter and nothing more. Note that typically, any guide prong is viewed as part of the cutter (as is any cutter's handle, of course).

Defluter:

The defluting cutter removes material from the foam fluted board to create a valley 21 in the board so that the board can be bent (e.g., 90°) along such valley. Such bends may be seen anywhere in the end product, e.g., in cushioning material that is at vertical corners of the container when it is on its side, as but one example. Generally, they may appear such that, e.g., their axes are vertical when the container they are positioned in is placed on its side, although this is not a requirement at all. Note that even where the material is up against the (possibly hard) container walls to cushion such walls, it may still be referred to as divider material (indeed, it plays a role in cushioning sub-compartments). In particular embodiments, the defluter removes material from the foam fluted board without cutting all the way through it; the faces of the two cuts that are a certain distance away from each other (e.g., slightly less than the left-right width of one flute) may be approximately at 90° angles to the flat horizontal upper (or lower) face of the foam fluted board. However, as explained below, the faces of such cuts may be at other angles to the flat upper face of the foam fluted board.

Dual Blades:

The defluting cutter, in preferred embodiments, includes two blades 22, 23 that are right and left of a vertical plane that may bisects them (one may be on a right portion of the cutter, while the other may be on a left side of the cutter). The blades are separated, as indicated above, by a left-right blade separation width, and thus cut along different (parallel) lines (where the lines are defined by the cut at the surface of the material closest to the cutter body) during the duration of the cuts (i.e., cutting operation). Of course, when the cut is sufficiently close to an edge of the foam fluted board that is perpendicular to the longitudinal axes of the flutes (i.e., at the start and finish of a defluting cut), only one blade is cutting. During the cut, in certain embodiments, one blade 22 is at a right side of the guide prong, and the other blade 23 is at a left side of that prong. The two blades may be substantially at the same vertical position (e.g., the lowest part of one blade may be at the same height as the lowest part of the other blade, and the highest part of one blade may be at the same height as the highest part of the other blade).

The blades may each angle upwards and towards the front of the cutter, thereby causing each blade to pinch the material between it and the prong 24, and thus facilitating a cut. The cut is achieved by the trailing part of the blade; the first part of the foam fluted board to contact the exposed part of the blade may be the surface furthest from the prong while the first part of the exposed part of the blade to contact the foam fluted board may be the part of the exposed portion of the blade that is furthest from the prong. This may apply not only to defluters, but also to through-cutters (which, of course, typically have only one blade).

Each of the two cuts made during a single defluting operation is typically through a layer of foam (e.g., an upper layer in the case of a manual, moving blade tool) and through a ceiling (floor in blade-in table versions) of a flute. In particular embodiments, when material is removed from above a flute, both such cuts are deep enough so they go through the same flute ceiling (or floor, for certain tools where the workpiece is above the cutter, as may be seen in table saw type, moving workpiece tools); the deepest part of one such cut may be at the far right of the flute ceiling/floor (but just immediately left of the right wall of that flute), and the deepest part of another of such cuts may be at the far left of the flute ceiling/floor (but just immediately right of the left wall of that same flute). Note that cuts that are smaller in width (at the height where they cut the flute) may still achieve the intended purpose of facilitating formation of a bend. Upon both cuts piercing that flute ceiling (or floor when the cutter is below the workpiece), the portion of that ceiling/floor between the two cuts, and the foam above that portion of the ceiling (or below the floor when the cutter is below the workpiece) becomes partially detached from the foam fluted board (partially because there will still be attachment to the foam fluted board in the yet-to-be cut area is completed). In certain embodiments, a removed material ejection ramp acts to divert the "removed" material upwards and rearwards, behind the tool.

"Staggered" Blades:

The two blades of the defluter (the defluting cutter), whether it's a moving blade or moving workpiece defluter, may be "staggered" such that one blade leads the other during a cut (one is a leading blade, and one is a trailing blade). Indeed, during a cut, the leading cutting edge of each blade (leading portion of the exposed part of the blades) is at a different position along the length of the flute being cut. In other words, during use of the defluting cutter/tool, one blade starts its cut at a distance from where the other starts its cut, where that distance is parallel to the longitudinal axes of the flutes. Such "staggering" allows material in the general region of the leading blade during a cut, but in the path of the trailing blade, to return to its "pre-cut" position/shape so the trailing blade can cut material in that region accurately, as intended. Typically, only an exposed portion of the blade actually cuts the material; when that portion becomes dull, in typical embodiments the blade may be removed, reversed, and reinserted so that a fresh, sharper portion of the blade is exposed to make a desired cut.

Recessed Blade Tips:

Another aspect of the inventive technology may relate to the provision of a recess 30, 31 on each of the outer left and outer right edges of the prong; such recesses provides a convenient backing for each trailing blade tip, assuring that when that blade is tightened/secured in position it is closer to the central plane that bisects the two blades than is right or left edge of the prong forward of the recesses (thus assuring that the cut does not hit a flute wall). The recesses, which, like the blades, may be "staggered," also help assure that the cut is completely through the foam and the ceiling of the flute by assuring the trailing tip of the blade, when secured, is below the flute ceiling (or above the flute floor where the cutter is below the workpiece). The recesses may be sweeped in shape (whether circular or not), allowing each to accommodate a variety of blade edge angles, blade tip shapes, and/or depth of penetration downward and rearward, along the blade edge, into the recess. Indeed, in certain embodiments, the blades may be adjusted to any of a plurality of blade edge angles via, e.g., the provision of recesses in the sides (right and left) of the cutter body and prongs that allow for some positional adjustment (this is not a required feature, however). Blades 22, 23 used in the cutter may generally be any type of sufficiently sharp blade, such as a razor blade. Note that recesses may simply be, e.g., a machined or molded depression of shallow, very possibly equal, depths in a right-left direction into the prong of the cutter (e.g., when viewed from above, depth may be 0.717 mm (or 0.028") inside (towards a central vertical plane of the cutter body or of the prong) the non-recessed right and left-most surfaces of the prong, or within a window centered on that specific dimension that is 100%, 80%, 60%, 50%, 40%, 25%, 15%, 10% and 5% that dimension, as but a few examples), thereby positioning the blade in a desired left-right position relative to the rest of the prong and the right-left flute walls to be cut. As with any ranges, angles or dimensions indicated herein, these are merely exemplary, and do not act to limit dimensions that can be used in the various embodiments of the inventive technology.

Removed Material Ejection Ramp:

The defluter may include a removed material ejection ramp 32, particularly in those embodiments where the cutter is substantially above the foam fluted board of the divider material during a cut. The rearward half of the ramp may have an average angle relative to horizontal of from 10° to 50°, although preferred embodiments of defluting cutters with ejection ramps may have ramps with a rearward half that exhibits an average angle of from 20° to 40°, such as substantially 30°, as but a few examples. Such ramp may be configured so as to divert removed material (which includes partially detached material) upward and behind the cutter, and, as but one possible advantage, may help to keep it conveniently out of the way of the operation. Such removed (but partially detached) material is still attached to soon-to-be cut material ahead of the cutter until the cut is complete.

Figure 6:
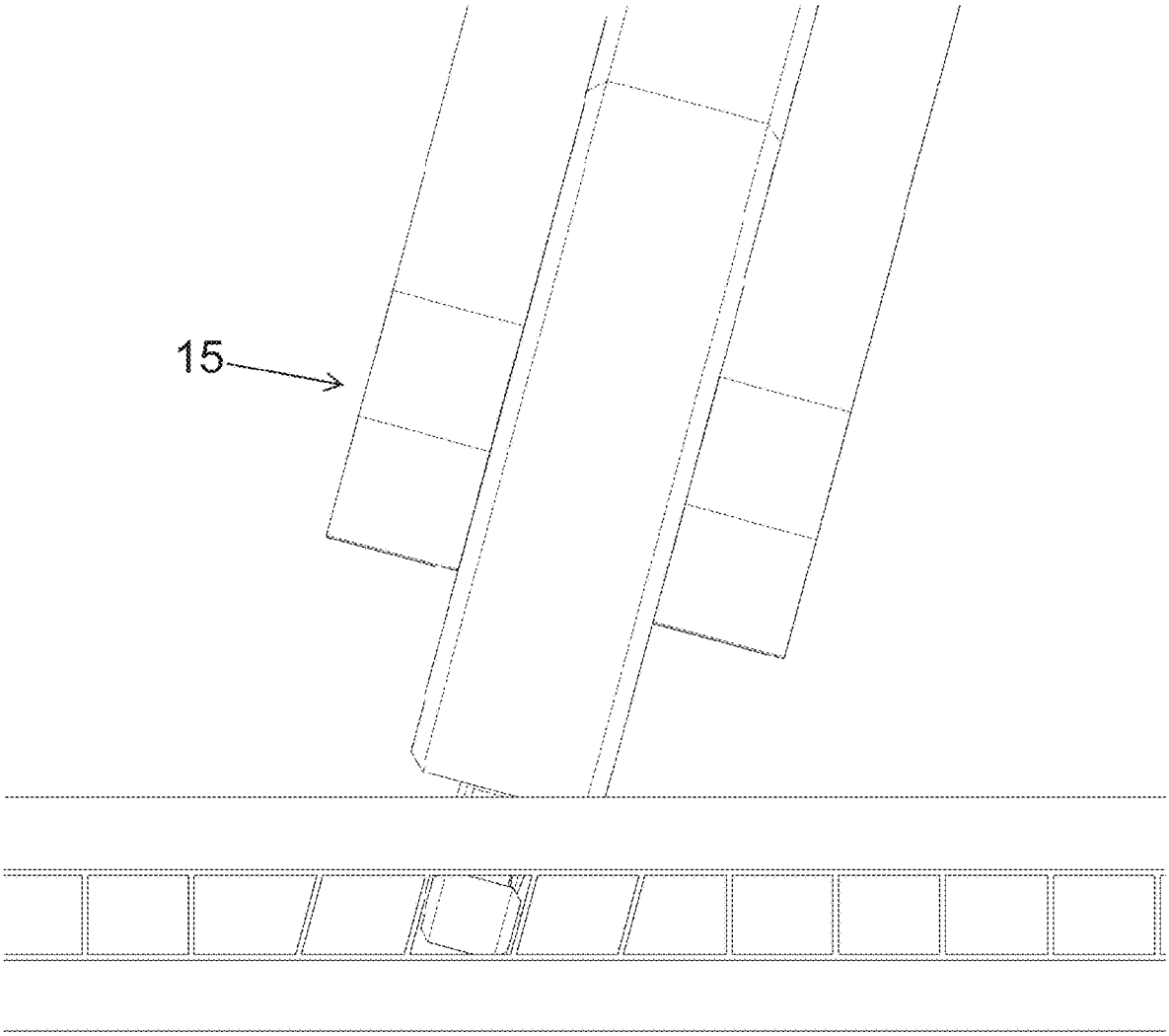
FIG. 6 shows a front view of a defluting cutter established in a flute during a cut, exhibiting a tilt to match the angle of the left and right walls of the flute being cut.

The inventive technology also includes methods of use of the cutters and their associated tool. As regards the defluter, foam and the flute (more particularly, the flute ceiling) may be cut at the same time, and removed from the board, leaving a valley in the foam fluted board. With manual and unguided tools, the cutter may be tilted left and right (in a "roll" direction (of roll, pitch and yaw)) by a user as necessary to match the off-vertical tilt of the walls of the flute whose ceiling/floor is to be removed (such angle might possibly be an average angle of the left and right walls of the flute). See, e.g., FIG. 6. Without such adjustment, the cut may get off track, and cut outside of the intended flute. Such adjustment may be a type of tactile response by the user/operator of the cutter. Walls may be slightly off-vertical due to, e.g., manufacturing imperfections. To allow such tilting, "on the fly" roll adjustment, the cutter may be without any outrigger components, e.g., stabilizing components such as wheels on the right and left of the cutter. However, such stabilizing outrigging components, which may help to maintain the cutter at a desired angle (e.g., 90° roll angle) relative to the workpiece during a cut (when viewed from the front), may appear on certain tools where walls of flutes of fluted boards are not off-vertical, or on the through-cutter (where slight deviations in wall angle from vertical are inconsequential to the cut). Note that the defluter may have a tolerance of, e.g., 1/32" either direction of the intended right-left position of each of the cuts (other tolerances may apply, of course).

Through-Cutter:

The through-cutter 16 (as opposed to the defluter), may be used to cut all the way through a foam fluted board. It may, unlike the defluter, require only one blade 33. It may also not require the need to adjust its roll angle from 90° during a cut to match any tilt of walls of a flute to be cut. But like the defluter, it may have a central cutter body 34 (e.g., a shaped plate), and a guide prong 24. Note that the blade, in certain embodiments, may pass through a slot along a central vertical plane of the prong, said plane along the prong's longitudinal axis. The blade may, in certain embodiments, be secured against the cutter body in a recess on a side of that body. That recess may be deep enough so that the blade secured against the vertical "floor" of that recess is substantially along a central plane of the cutter, although this is not a requirement.

Guide Prong:

A guide prong 24 may be used as a component of the defluting cutter (and the through-cutter); it may have a variety of widths (in a left-right direction), but where the cutter is intended to deflute only one flute (during a single pass), as in certain preferred embodiments, its width typically will be less than the entire width of the flute (e.g., slightly less, such as between 80%-100% the average left-right width of a flute, between 85% and 95%, substantially 90%, between 95% and 100% that width, as but a few examples). Certain ranges (e.g., those centering on 90%) may be preferred because of the variations in the size and the shape of the inner layer of the foam fluted board (the corrugated fluted board core). The height of the prong may have similar size relation to the channel height. The guide prong, as a component of either the defluter or through-cutter, may have, in cross-section (in a plane that is orthogonal to the forward "use" direction of the tool), four flat sides (i.e., flat top, flat bottom, flat right side and flat left side) along the vast majority of the prong (e.g., except for at the leading and trailing tips of the prong). Such, particularly when the guide prong is sized to be only slightly smaller than the channel, may help to stabilize and/or level the prong (and thus the tool) as it moves through the channel (in those channel designs where walls, floor and ceiling are flat), resulting in a more precise and predictable cut; indeed, all four sides of the prong may be slightly against a corresponding channel wall, floor or ceiling. Note that while such relative sizing, and flatness of all four walls of the prong, may provide optimal stabilization during cutting, some degree of stabilization and/or leveling may be provided in designs where fewer than all of the sides of the prong are flat, and/or where the prong, in cross-section, is not sized to be only slightly smaller than the width and height of the channel. Indeed, for example, where only the width of the prong is slightly less than the corresponding dimension of the channel (i.e., the channel width), flat prong right and left sides may provide an adequate stabilization and/or leveling effect. In certain embodiments, the prong is long enough (from front to back) to get it established in the flute, and maintain proper positioning of the blade(s) relative to the flute during the duration of the cut, but not so long that it is vulnerable to excessive leverage that will snap it off. In certain embodiments, it is connected directly to the cutter body.

Handle:

Any of the various cutters, particularly the manual cutters, may have a manually graspable handle 38. Such handle may be of a variety of configurations, and orientations, but in certain embodiments, the handle may be tilted up and rearward, away from the user during cutting. Such tilt may be at a variety of angles, but may, in combination with the substantially rearward location of the handle relative to the rest of the cutter, be intended to, inter alia, compel a proper distribution of downward force (generally applied by the user) on the workpiece, such proper distribution helping to stabilize the workpiece during cutting, and possibly to prevent it from "kicking" up. The shape and orientation of the handle may also allow use of the entire forearm, distributing force among as many fingers as possible (even all 4), and possibly also the thumb, thereby preventing excessive reliance on smaller muscles of the hand, fingers, wrist or arm, thereby mitigating stress and fatigue. The force exerted by the handle against the user during a cut may be primarily compressive, instead of primarily shear against skin of hand, including wrist, thumb and fingers.

The handle's shape in horizontal cross-section (e.g., at any of the various sections from top of handle to bottom) may allow and even intuitively encourage the use of a prehensile power grip; depending on the exact shape of the cross-sectional shape that grip may be a cyclindrical wrap, or a hook grip. In general, the prehensile grip is as if one were to grasp a hammer, and then situate the hammer vertically, with the hammer head directly above the handle and its base. The handle, during operation of the handheld cutter/tool, may have a longitudinal axis 39 that is upward and rearward, and that has an angle with respect to horizontal that is among the following ranges: between 30°-90°, 40°-90°, 50°-90°, 60°-90°, 70°-90°, 75°-85°, and substantially 80°. Note that the handle need not be an attachment to the cutter body, which may be characterized roughly as a shaped plate of metal or plastic (or other sufficiently strong and rigid material); indeed, the handle may be an integral component of the body. When integrated, its core would typically of the same material as the body (e.g., metal, plastic, nylon, fiber-reinforced material, etc.); otherwise, its core may, but need not, be of a material(s) that are different from that of the cutter body. The handle, when not integral of the cutter body, may be attached in any number of ways (e.g., bolts, adhesive, locking clip, etc.). The handle need not be substantially rectangular as shown; it can have any of a variety of shapes, including ergonomic shapes (such curved shapes still have a longitudinal axis).

Blade(s):

The blade used in any cutter may be any of a variety of blades, such as a commercially available (cold) razor blade. There may be a recess in the body of the cutter above the prong in which the blade may fit (for the defluter, there may be two recesses, one on each side of the body). In the through-cutter, the blade may fit up into a central slot in the cutter body, or instead the blade may fit into a recess on one side of the cutter body. In any design, the blades may be removably secured to the cutter body (e.g., via bolts, as but one example). Indeed, blade removability (and the blade replaceability that results from it) afforded by certain defluters and through-cutters, whether manual, movable workpiece or otherwise, may offer significant advantages given the high use nature of the tools and the frequency with which blades dull.

Note that both cutters may, regardless of shape or the presence or absence of symmetry, have a nominal central vertical plane that divides the cutter into substantially a right portion and a left portion (such portions need not be identical, or mirror images of one another, although they certainly may be). Such plane would typically pass through the mass centroid of the cutter and be aligned with the forward-reverse direction of the cutter during use.

As mentioned, both the defluter and the through-cutter can be moving blade (as where the cutter is moved, either manually or powered, with respect to a stationary workpiece), or moving workpiece (as where the workpiece is moved, either manually or powered, with respect to a stationary cutter (e.g., as where the cutter is substantially immobilized in a table)).

In unguided embodiments of the moving blade cutter, the tool itself may be nothing more than the cutter, but, in at least partially or fully guided moving blade versions (e.g., table version), the tool can include the cutter, any table, and components that guide the cutter during its movement during a cut operation, any cutter compartment or head, and perhaps also components that position and stabilize the stationary workpiece (in manner analogous to the Keencut® mat cutters). Such guidance may be in the form of fencing, templates, stops used in conjunction with manual moving blade cutters, perhaps to assure a straight cut. Such guides are only considered part of the tool where, e.g., the guide is clearly part of a larger tool, as with a Keencut® mat cutter type tool; where a guide is instead merely an added-on jig of sorts to improve the cut, such as one that is merely clamped in position and not purchased as part of the tool, it is not considered part of the tool.

In moving workpiece tools (e.g., blade-in-table, moving workpiece type through-cutter tool 40, or blade-in-table, moving workpiece type defluter tool 41), certain embodiments may be analogous to a table saw (see, e.g, FIGS. 35-38), where, e.g., the blade projects upwards (perhaps protected), and the workpiece is slid along a table, perhaps guided by a fence, so that the workpiece is moved over the blade to produce the desired cut. In certain such embodiments, a fence that guides movement of the workpiece may be used (whether in manual or powered versions); such fencing, the table, and the recess in the table that holds the cutter or a cutter cartridge, may be considered parts of the tool (in addition to the cutter, of course).

Cutter (and tools) can either be manual or powered. Unguided cutters (e.g., with no fencing, and no outrigging), particularly with respect to the defluter, may be advantageous in allowing for "on-the-fly" adjustment during operation, such as allowing for a tactile response by a human operator directly holding the cutter/tool to cut in a manner that tracks the angle of the walls of the flute to be cut. Powered versions will typically be at least partially guided; manual versions can be guided (whether fully or partially), as where, e.g., a fence, cutter outrigging, or template is used), or unguided.

Methods of using the through-cutter tool are also part of the inventive technology. The cut made by the through-cutter may be down the center of the flute (e.g., +/−⅛" or +/−3/16" of the exact centerline); material is separated, instead of what is seen with the defluter, where material is removed. The through-cutter is typically not tilted (in a roll direction) during operation.

Note that any of the features/dimensions of the cutters disclosed herein, including in the figures, may apply to cutters whether they are part of a moving blade tool or a moving workpiece tool, powered (fully or partially) or manual, or guided (fully or partially) or unguided. However, as but one example, typically the fully powered versions typically need not have a handle. It is of note that each of the components mentioned herein may have a variety of different sizes/angles/dimensions. For example, the distance (in a right-left direction) between inner surfaces of blades of the defluter may be 2.57 mm (on center distance may be 3.175 mm; the amount of offset of the blades into prong (depth of recess) may be 0.717 mm; the angle of the blade(s) at the part thereof that cuts the foam fluted board may be 30° relative to horizontal; the angle of handle (perhaps average) may be 80° relative to horizontal; the angle (perhaps average) of the angle of the rearward half of the ejection ramp of the defluter may be 30°; the distance along the cut from the tips of the two blades of the defluter may be approx. 10 mm; the width of prong may be approx. 4.0 mm; the height of the prong may be approx. 3.3 mm; the length of the prong may be approx. 65.0 mm. In fact, other dimensions/angles can be used (e.g., within a window centered on an indicated dimension that is 100%, 80%, 60%, 50%, 40%, 25%, 15%, 10% and 5% that dimension, as but a few examples).

It is of note that it the defluter need not necessarily have blades that are substantially at 90° to the horizontal face of the foam fluted board (i.e., where the blades are both substantially vertical). Indeed, any of a variety of angles could be used. For example, during such non-perpendicular cuts, the blades may each be canted outwardly from the cutter body at, e.g., a 45° angle (as but one example) relative to a central plane of the cutter that bisects a cutter body. Indeed, such cuts may be advantageous in that they may remove more foam material above the core of the divider material (the fluted board). Removal of more material may facilitate bending along a longitudinal axis of that removed material, particularly for bends of divider material having relatively small left-right flute width, or for bends to material that are less than 90° (internal angle).

Note that, while certain embodiments, as indicated above, may relate to cutting (defluting or through-cutting) with a hand-held bladed tool, certain other embodiments may involve: a CNC engineered cutting process; and/or a grinder version of the cutting/material removal process. Grinding may be achieved via, e.g., rotating abrasive belt, spinning stone, belt sander, traditional grinder. A spinning bit, e.g., a router or rotozip, may be used to cut/remove material. While the CNC engineered cutting process is often entirely automated (i.e., not manual in any respect), the grinder version may or may be manual (e.g., where a human holds and operates a grinding tool, or manually moves a workpiece through a stationary grinding tool), but need not be.

In particular embodiments, width of pins (i.e., distance between legs of U-shaped pins (including pins that, when installed as shown in FIG. 1, roughly have a Π or ∩ shape)) used to connect divider material may be dependent on the thickness of the foam layers and the size/thickness of corrugated plastic (the fluted/corrugated board core) used; indeed, given a particular thickness foam and corrugated board core, only pins with a width within a certain range may result in a functional system. Indeed, such width may be deliberately, and/or intentionally designed. Magnets may be used instead of, or in addition to, pins, in order to hold installed divider material in proper relative position. Cutting of board materials with certain tool embodiments and via certain method embodiments described herein may provide the precision needed for the integrity of the product. Failure to achieve such precision could result in failure of the system (e.g., pins not holding the dividers together) and a degradation in the quality of the product. In certain applications, it is desired to cut the divider material in the precise middle of a channel; such may be a very important step in the manufacturing of the product in certain embodiments.

Figure 7:
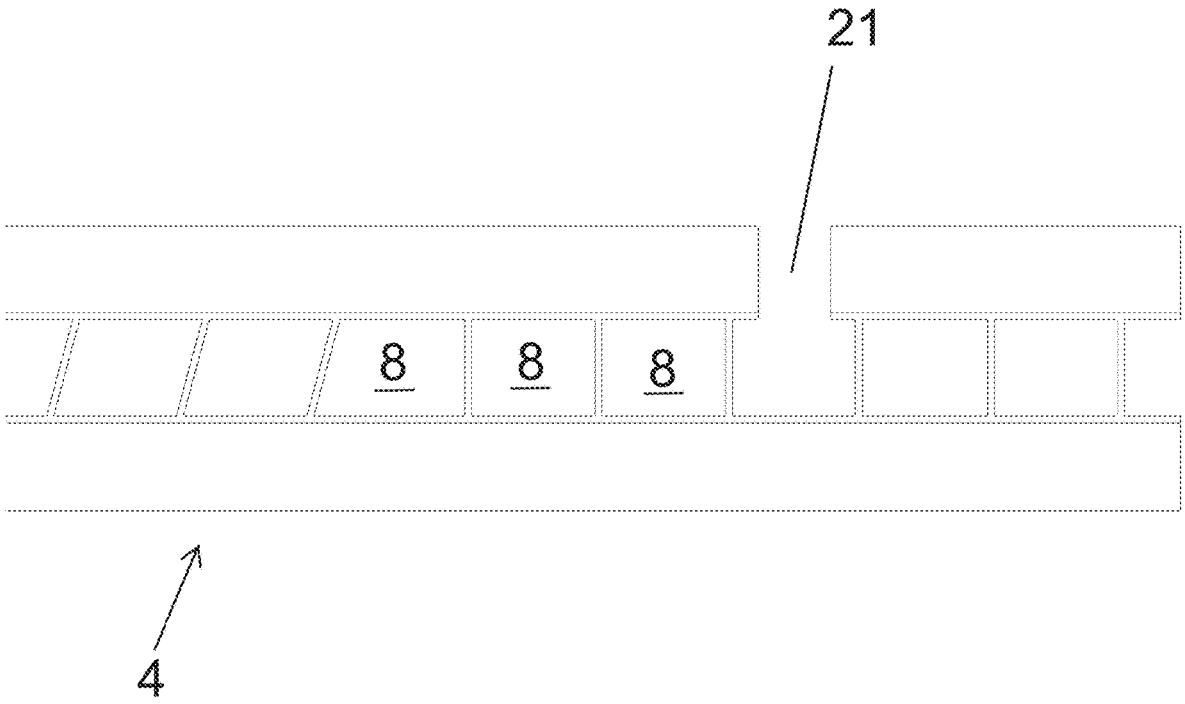
FIG. 7 shows a view of a defluted foam fluted board.
Figure 8:
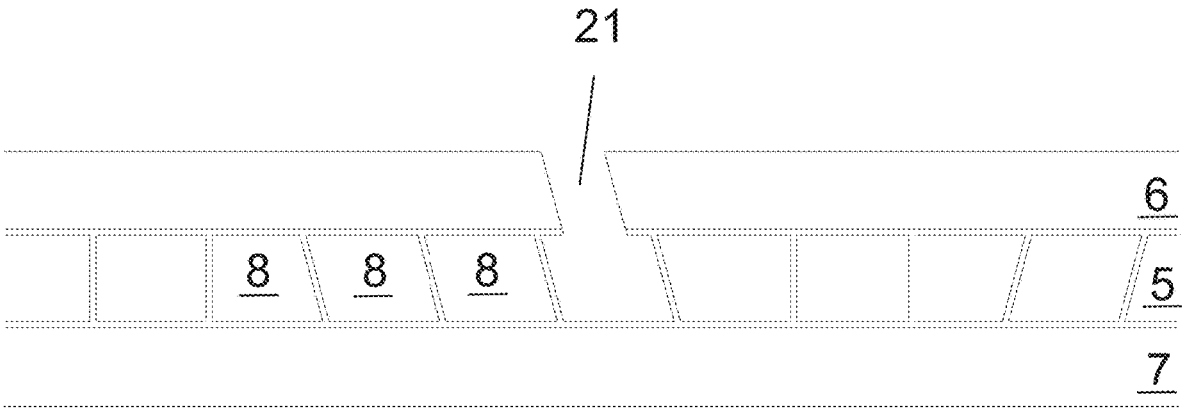
FIG. 8 shows a view of defluted foam fluted board, with off-vertical right and left flute walls.
Figure 9:
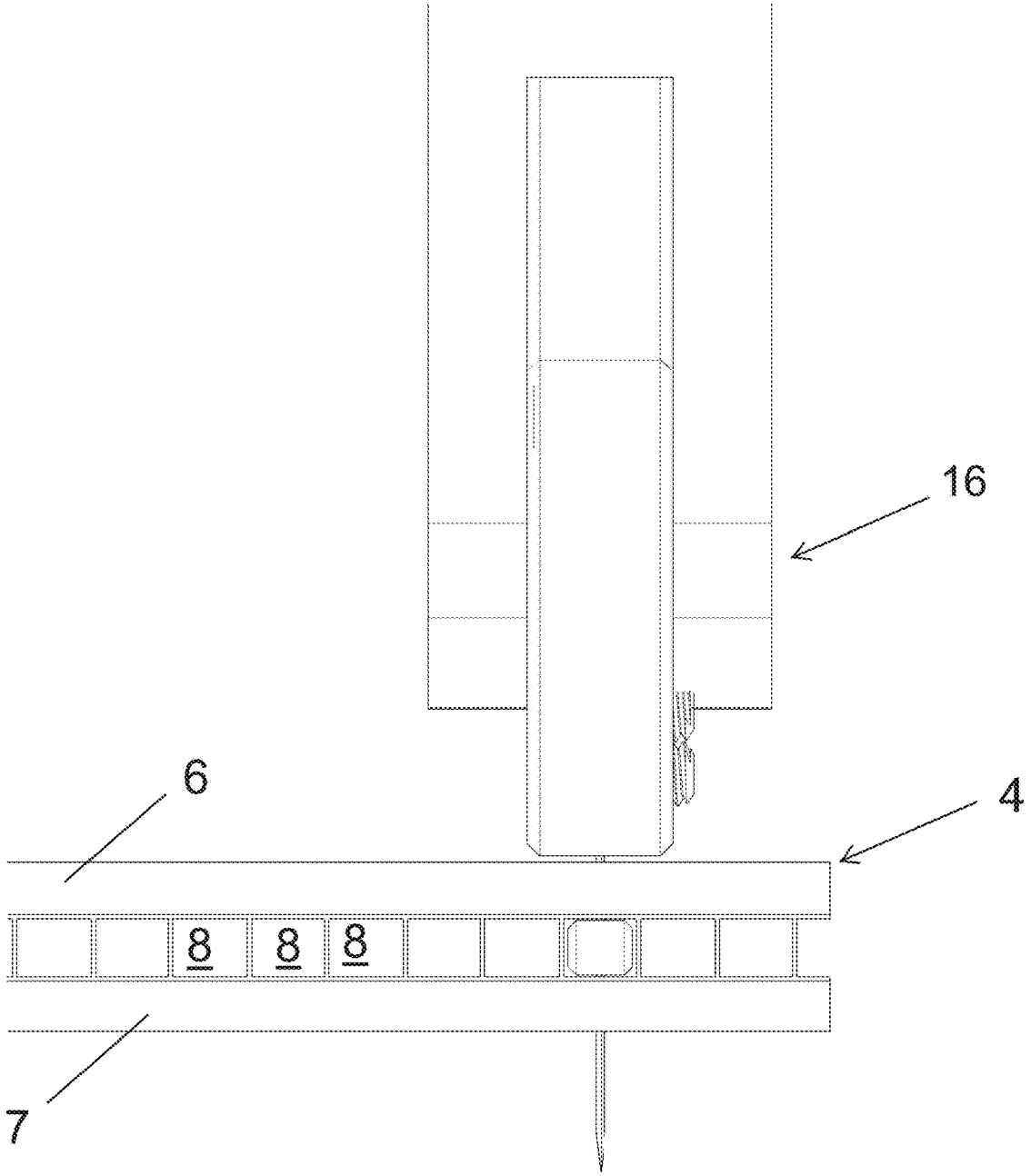
FIG. 9 shows a front view of a through-cutter while cutting a foam fluted board.
Figure 10:
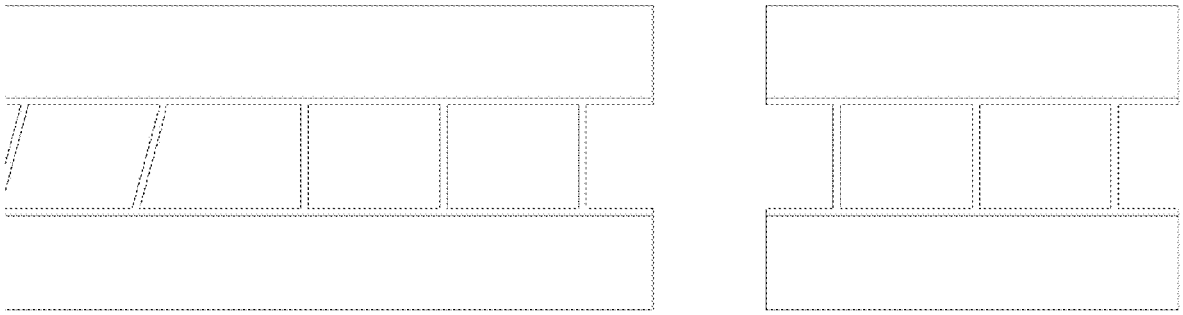
FIG. 10 shows a view of foam fluted board that has been through cut.
Figure 11:
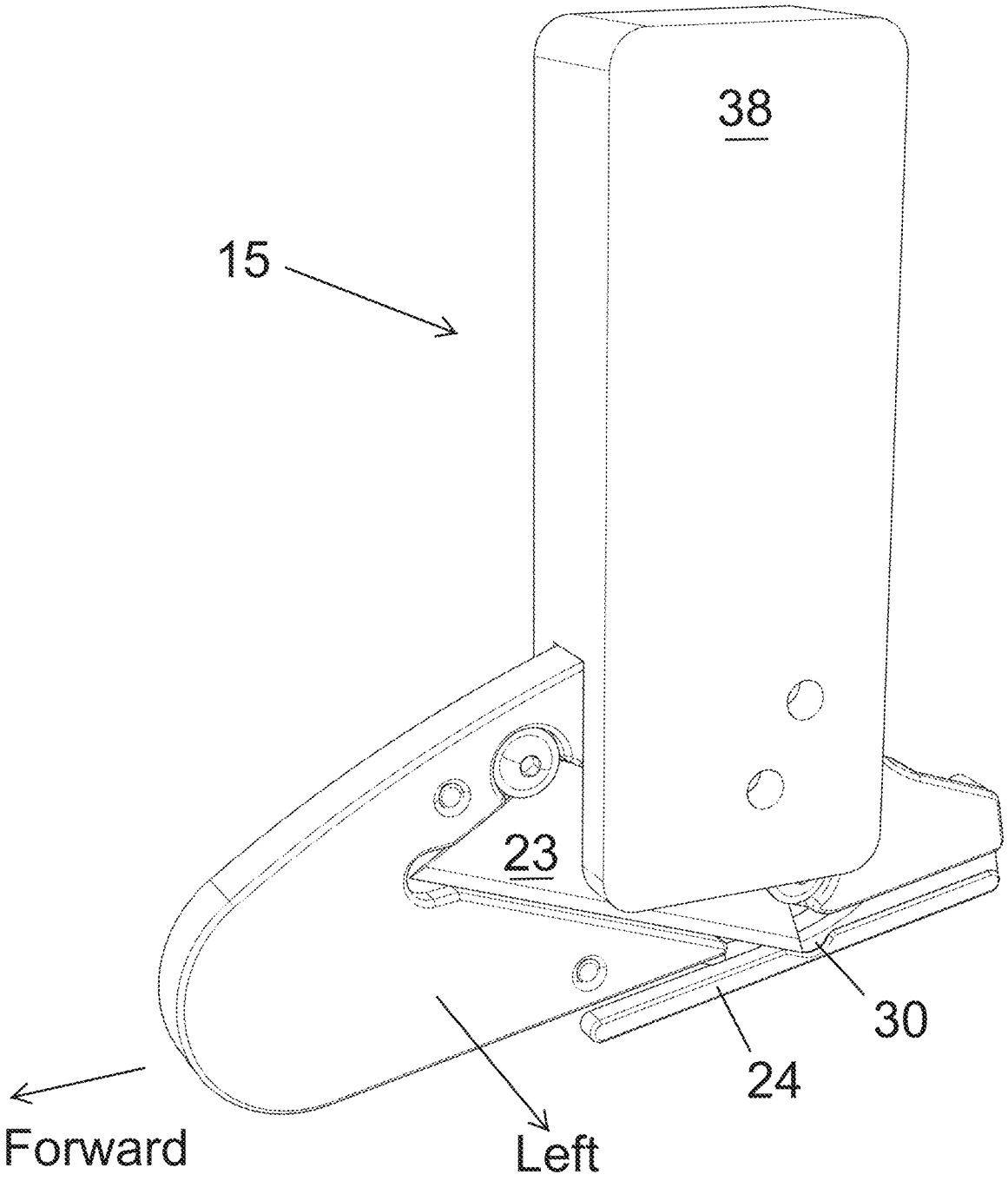
FIG. 11 shows a perspective view (from left, rear and above) of a manual (and unguided) defluting cutter.
Figure 12:
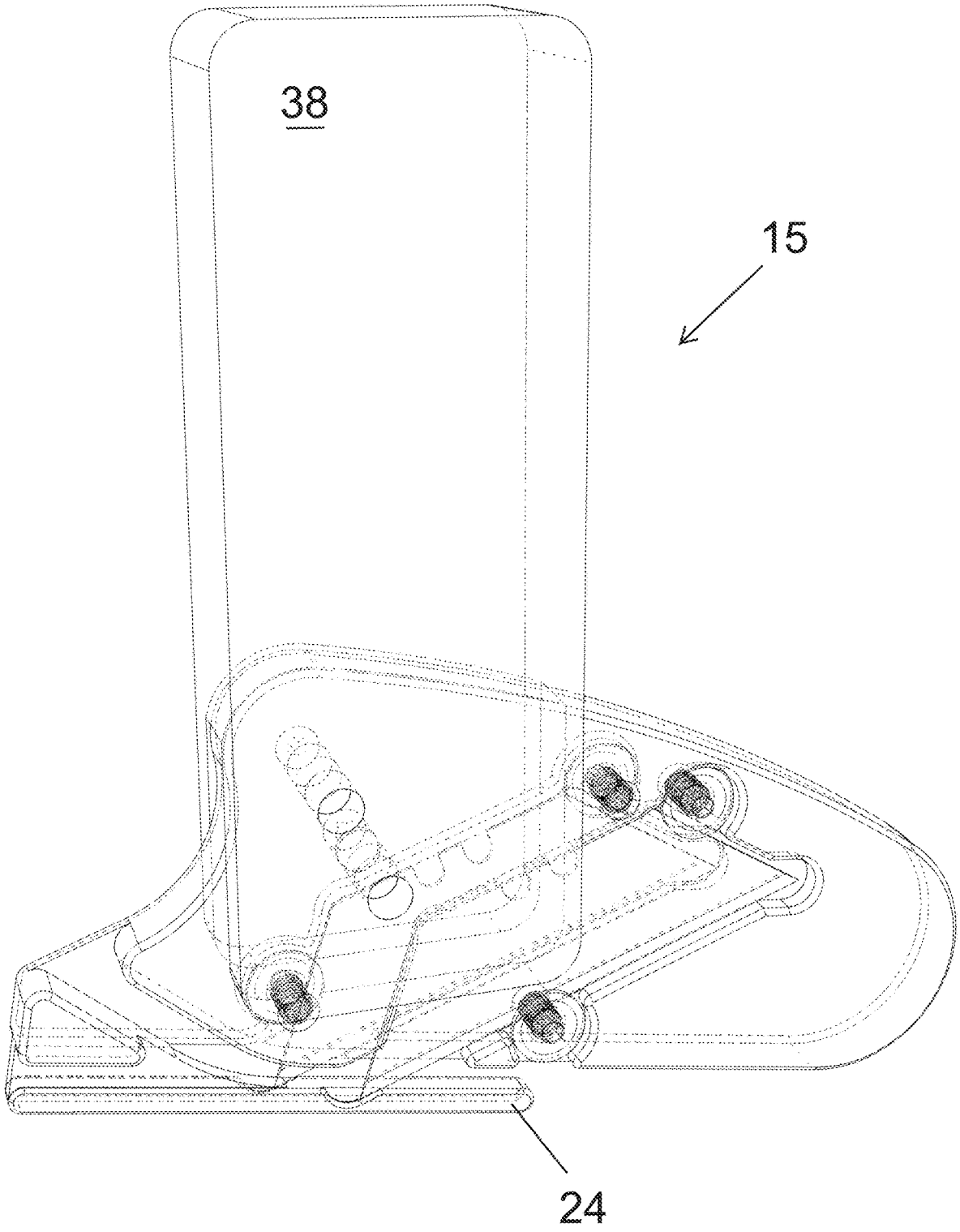
FIG. 12 shows a perspective view (from right, rear and above) of a manual defluting cutter (transparent view).
Figure 13:
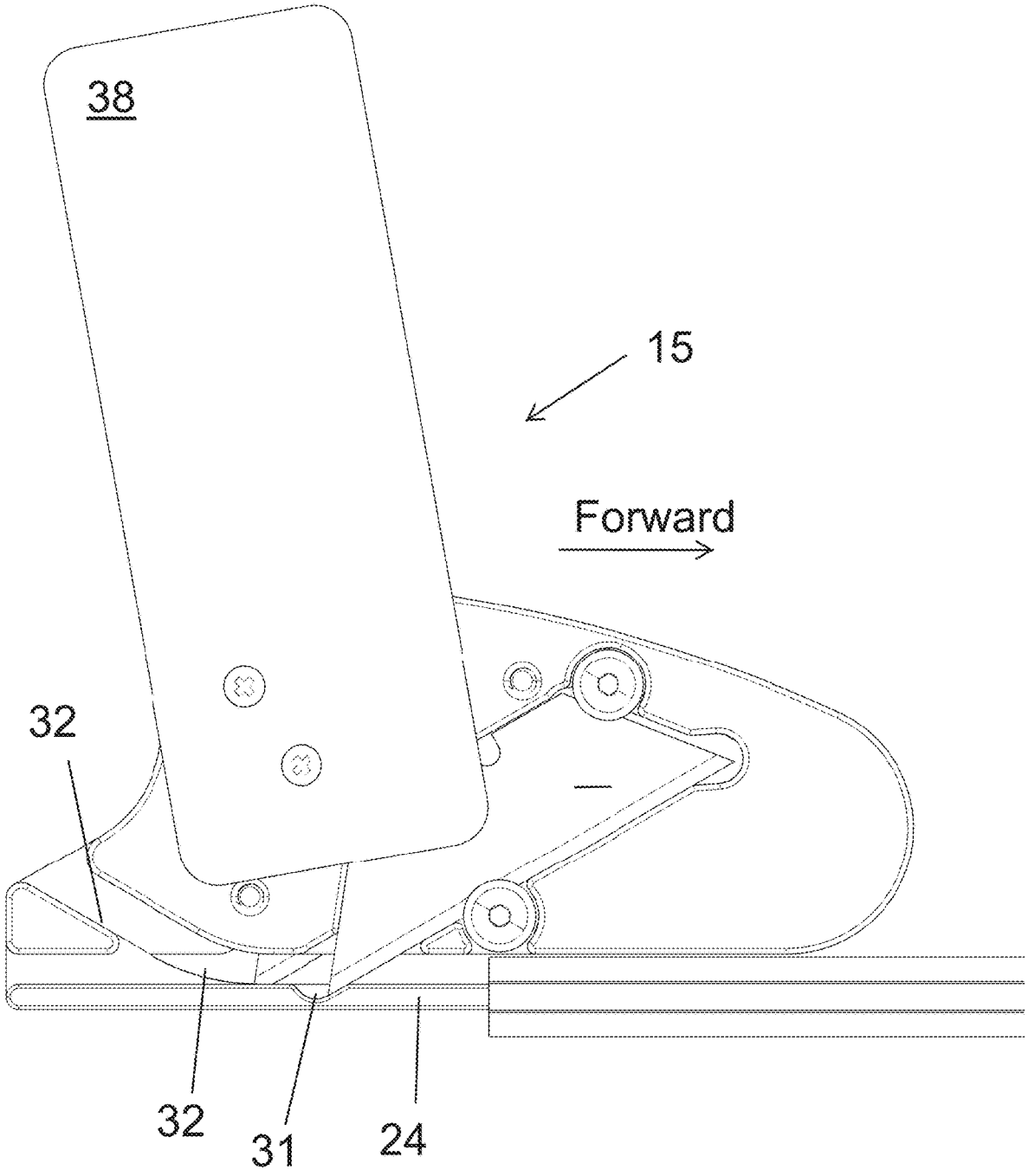
FIG. 13 shows a view from the right of a manual defluting cutter with its guide prong barely inserted into a flute (whose ceiling, and material above, is to be removed by the cutter).
Figure 14:
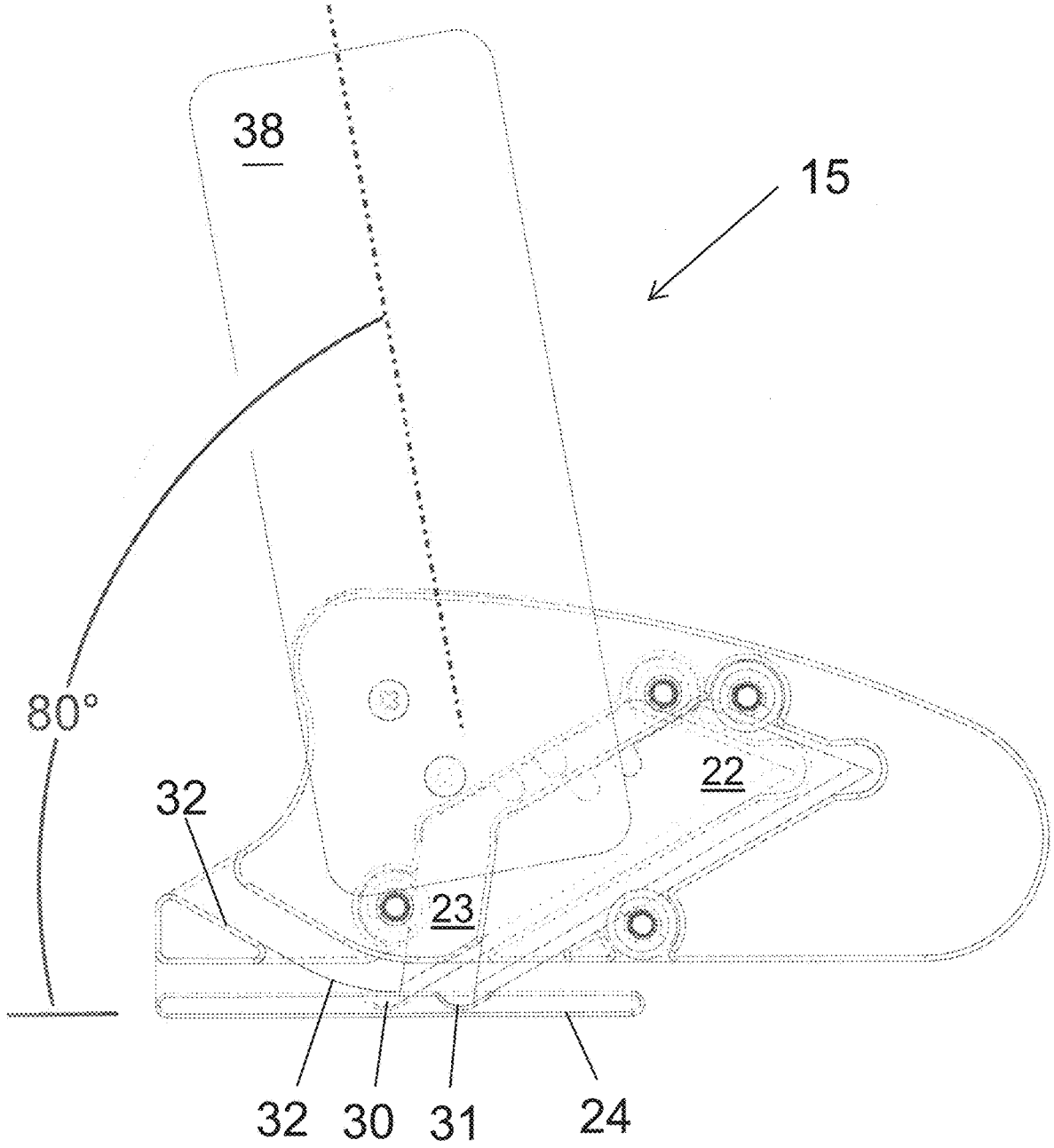
FIG. 14 shows a view from the right of a manual defluting cutter (transparent).
Figure 15:
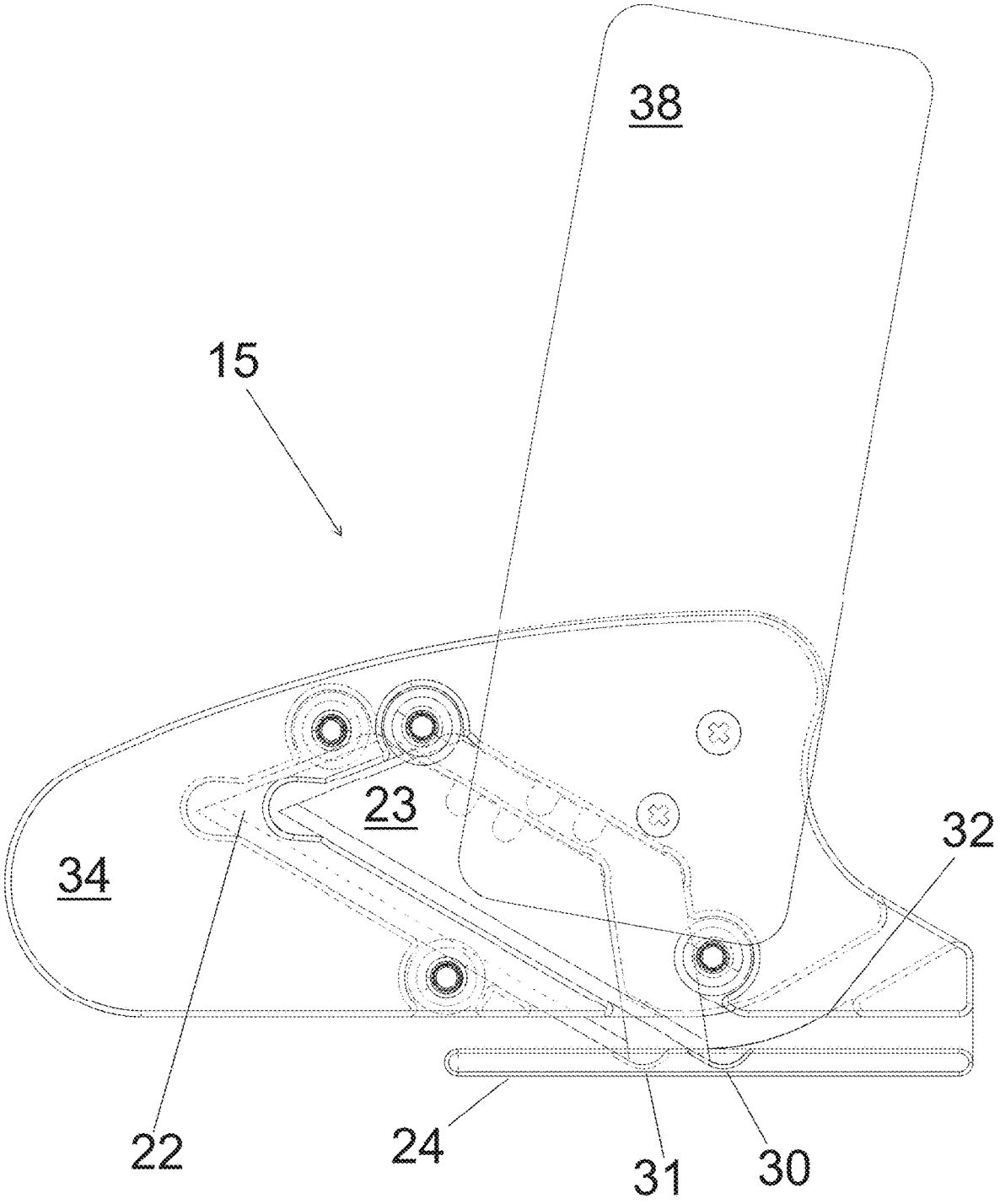
FIG. 15 shows a view from the left of a manual defluting cutter (transparent).
Figure 16:
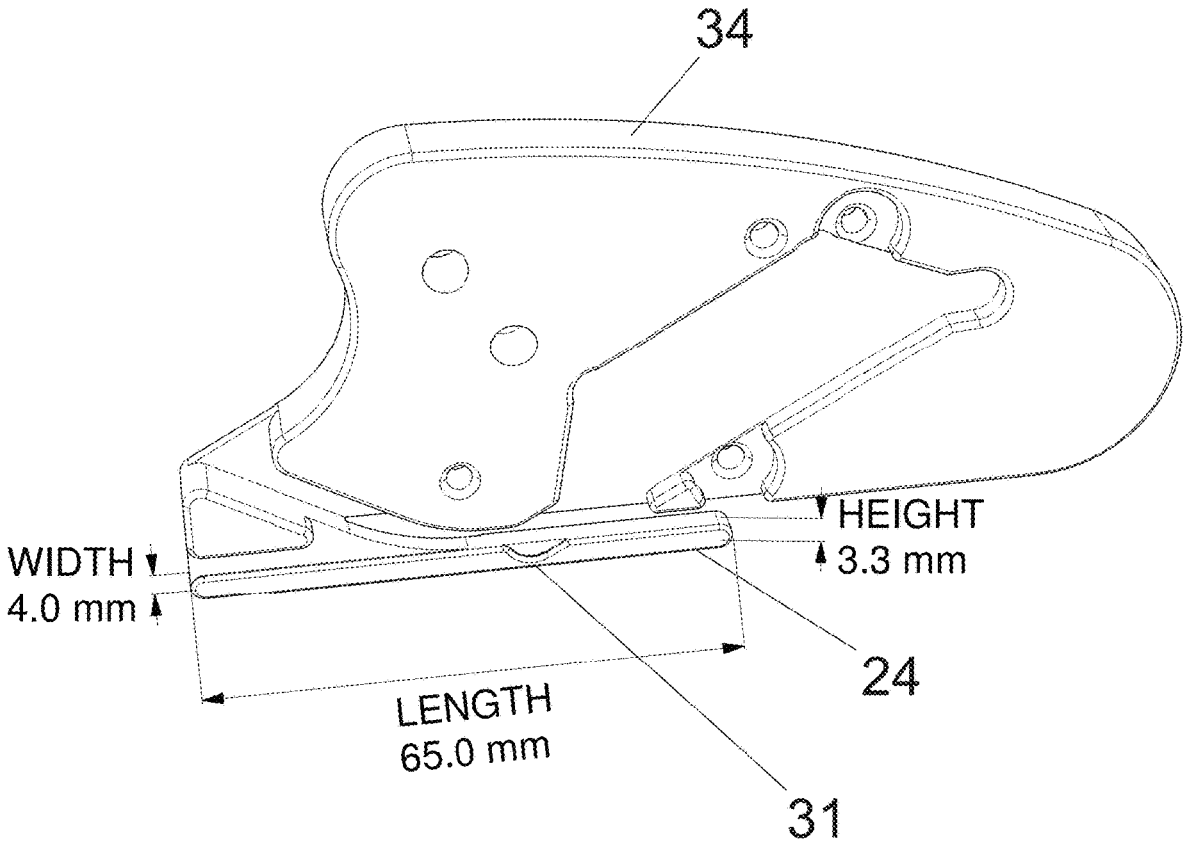
FIG. 16 shows a view of above and right of a defluting cutter body, prong and removed material ejection ramp.
Figure 17:
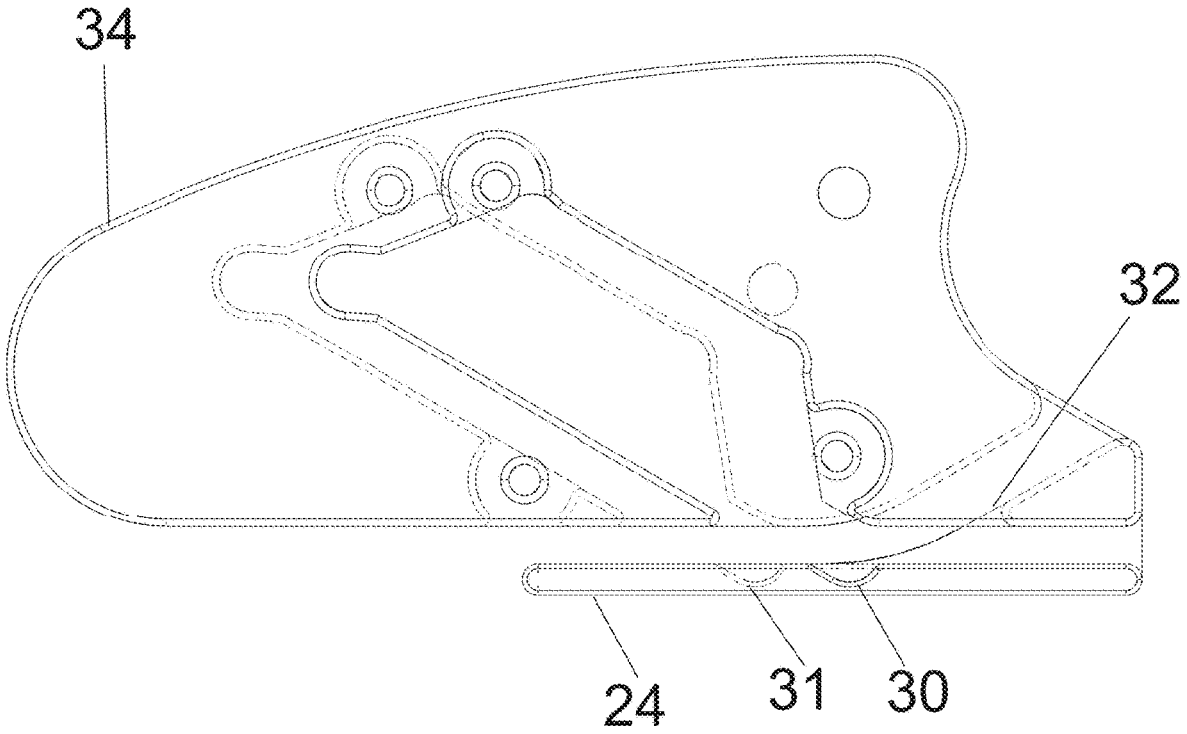
FIG. 17 shows a view of a cutter body of a defluting cutter from the left (transparent).
Figure 18:
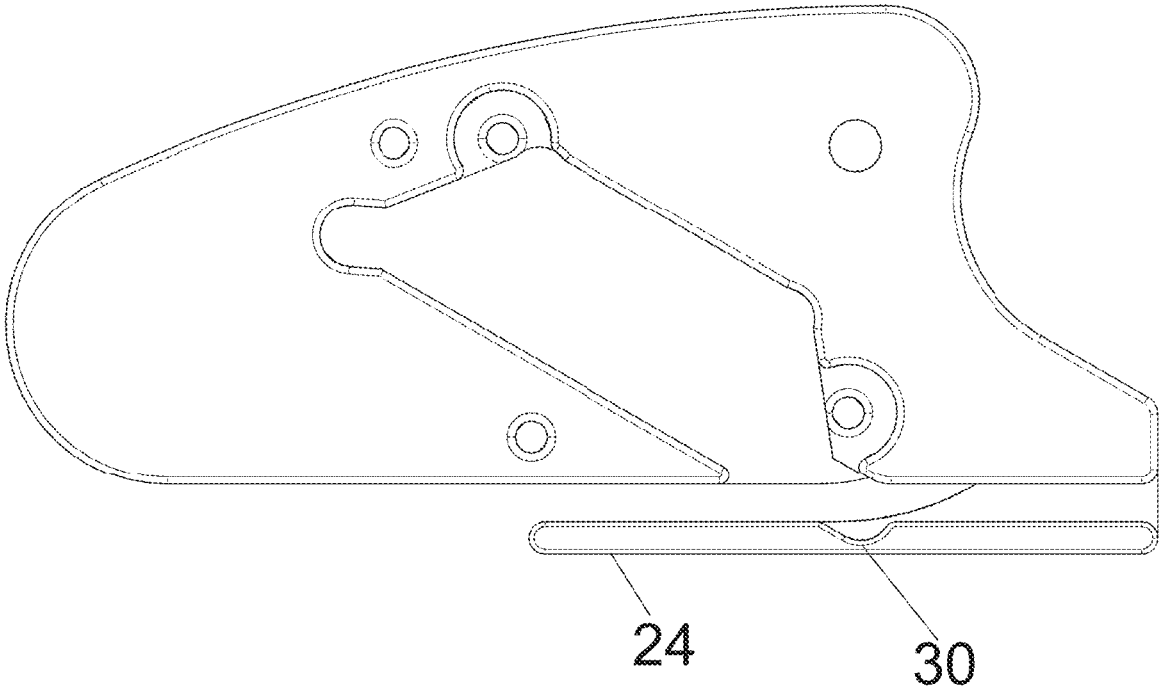
FIG. 18 shows a view of a cutter body of a defluting cutter from the left.
Figure 19:
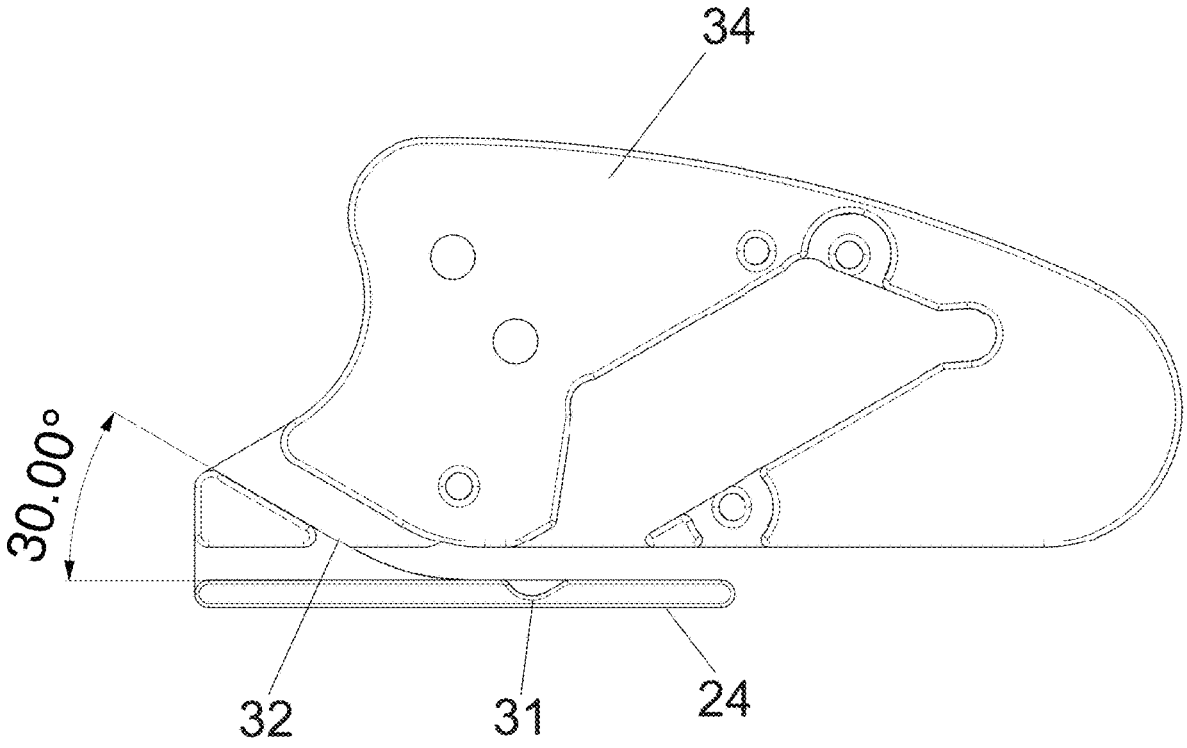
FIG. 19 shows a view of a cutter body of a defluting cutter from the right.
Figure 20:
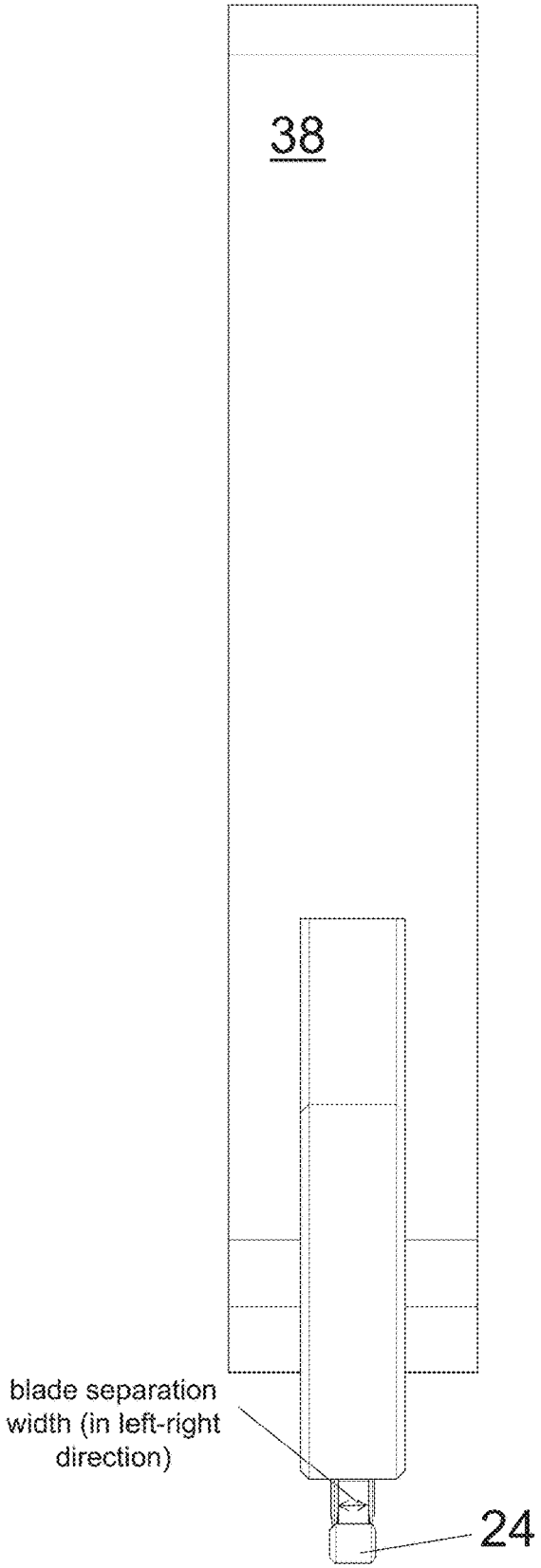
FIG. 20 shows a view of a manual defluting cutter from the front.
Figure 21:
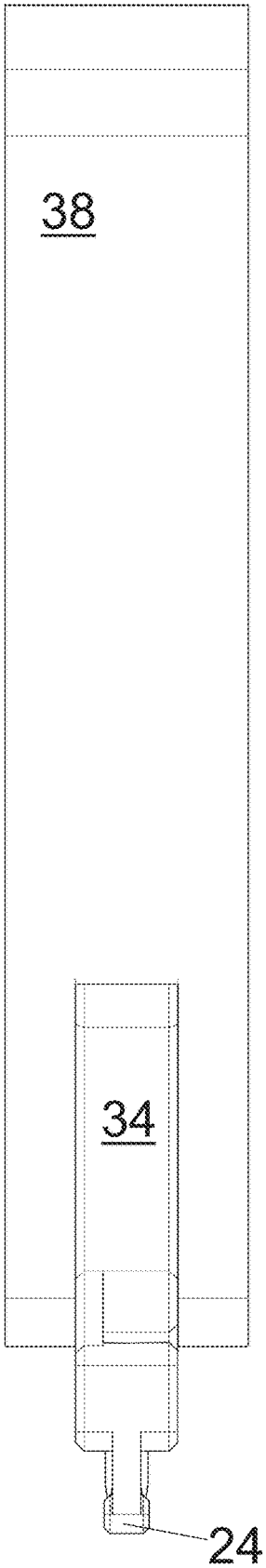
FIG. 21 shows a view of a manual defluting cutter from the rear.
Figure 22:
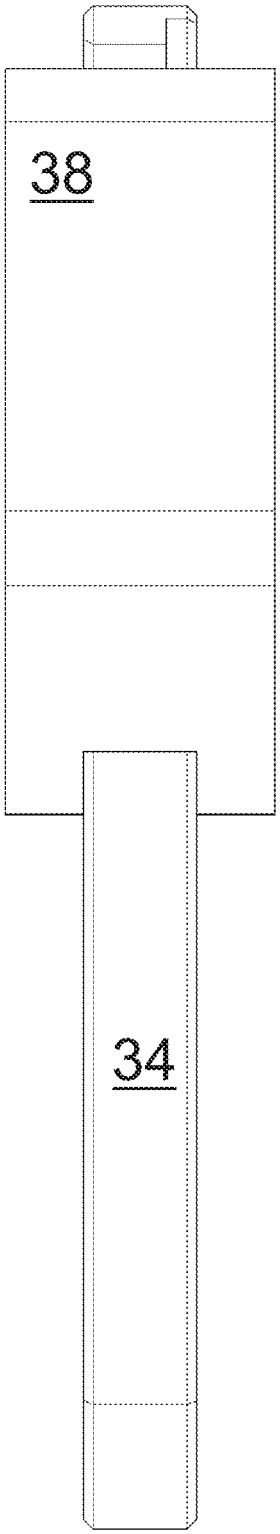
FIG. 22 shows a view of manual defluting cutter from above.
Figure 23:
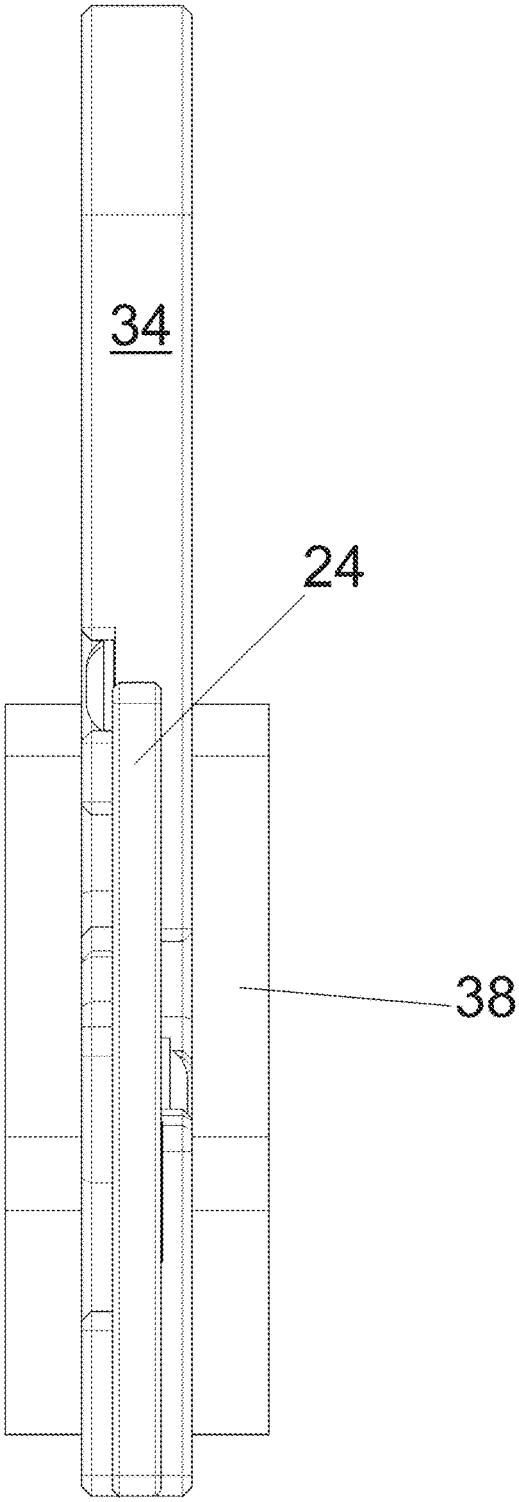
FIG. 23 shows a view of a manual defluting cutter from below.
Figure 24:
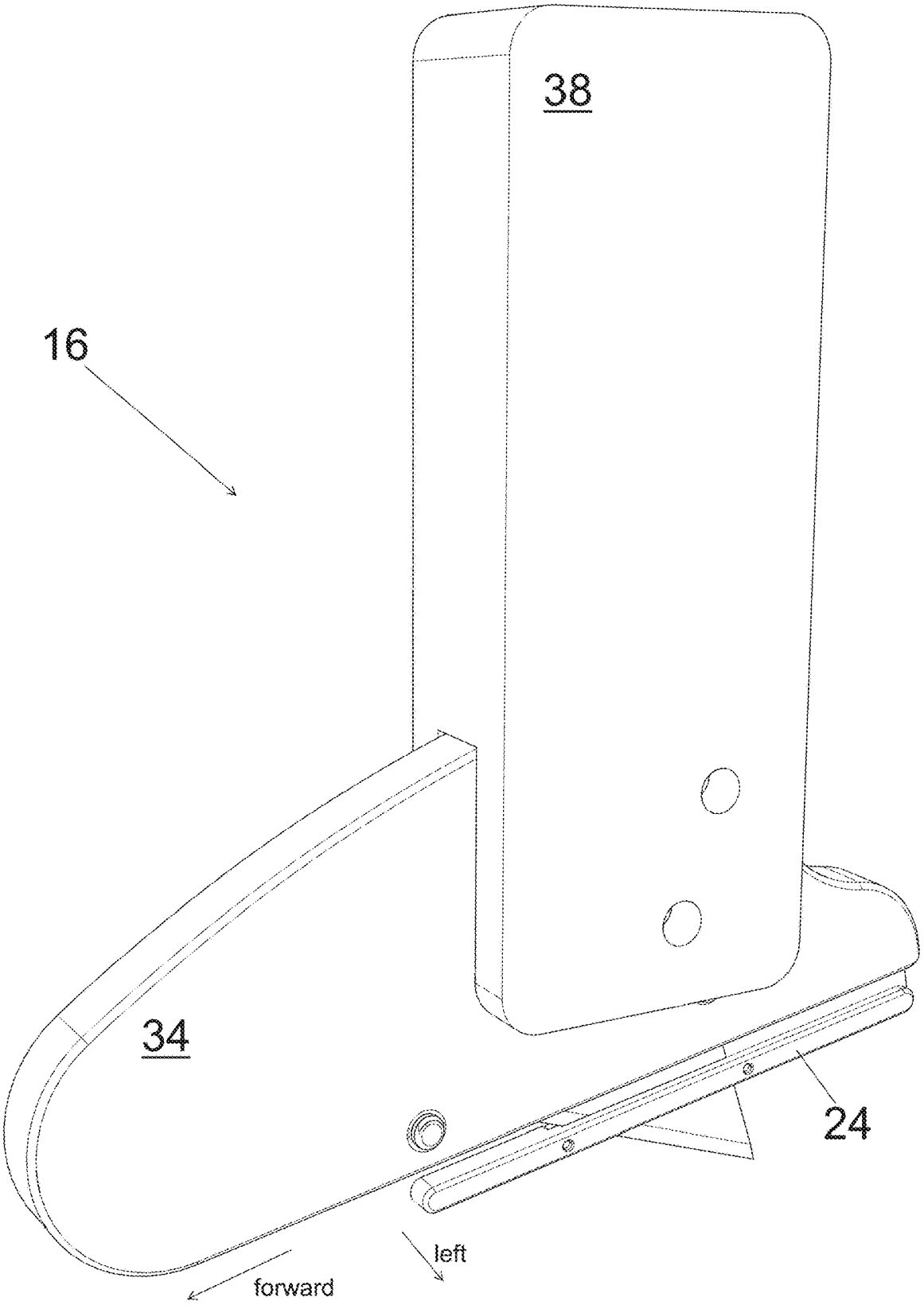
FIG. 24 shows a view from above, front and left of a manual through-cutter.
Figure 25:
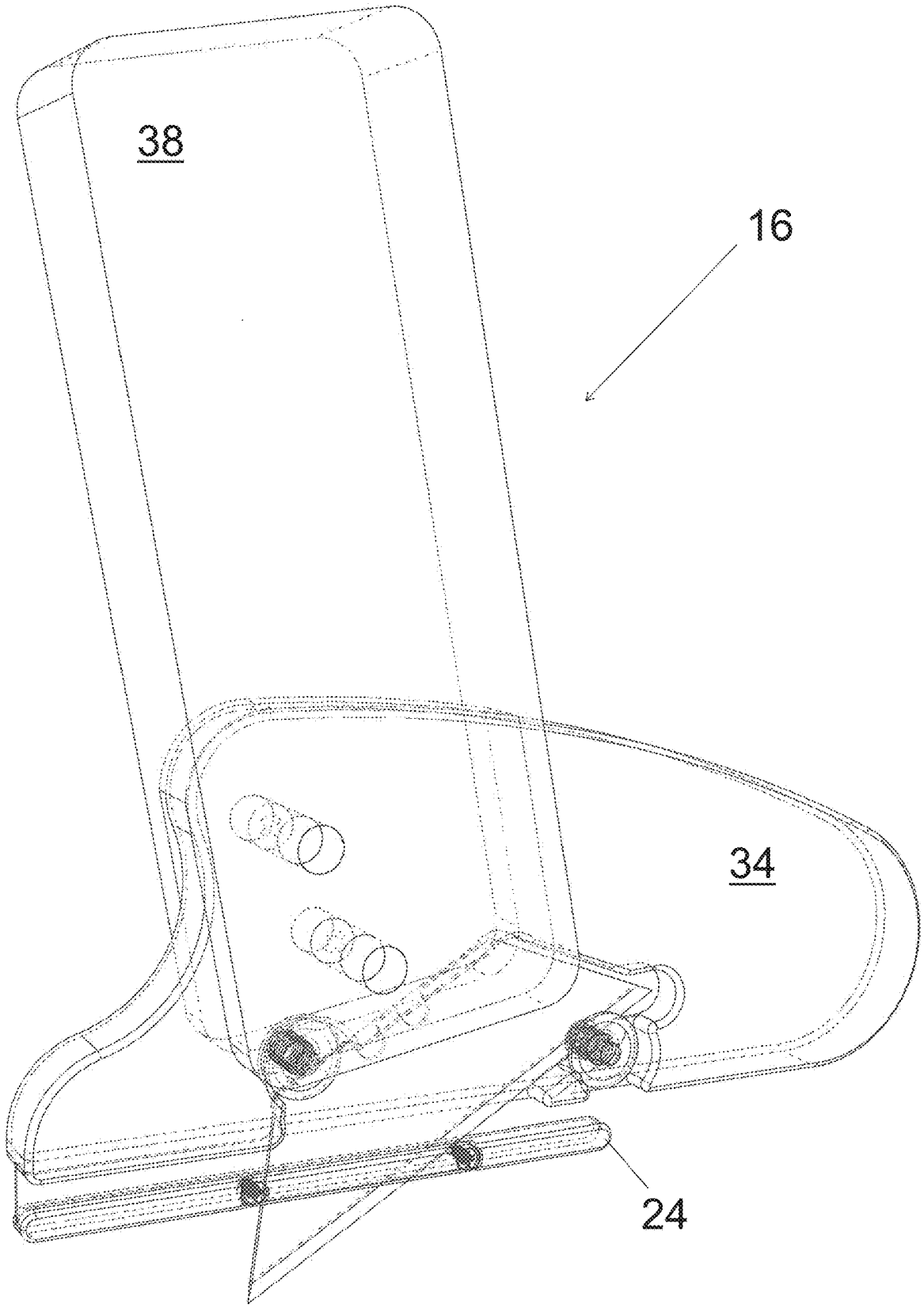
FIG. 25 shows a view from behind, front and left of a manual through-cutter (transparent).
Figure 26:
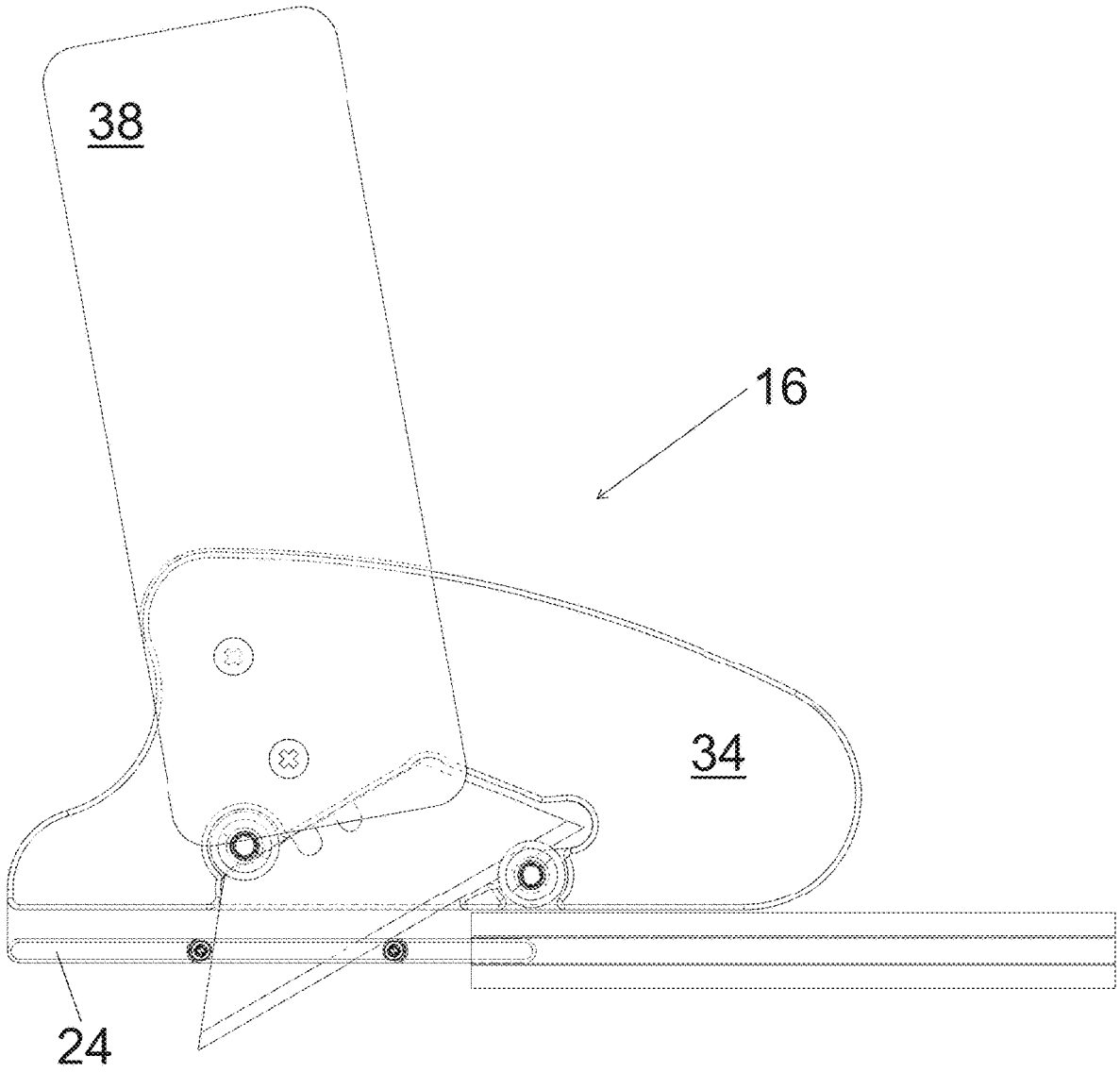
FIG. 26 shows a view from the right side of a manual through-cutter with guide prong established in a flute of foam fluted board, just before cutting is initiated.
Figure 27:
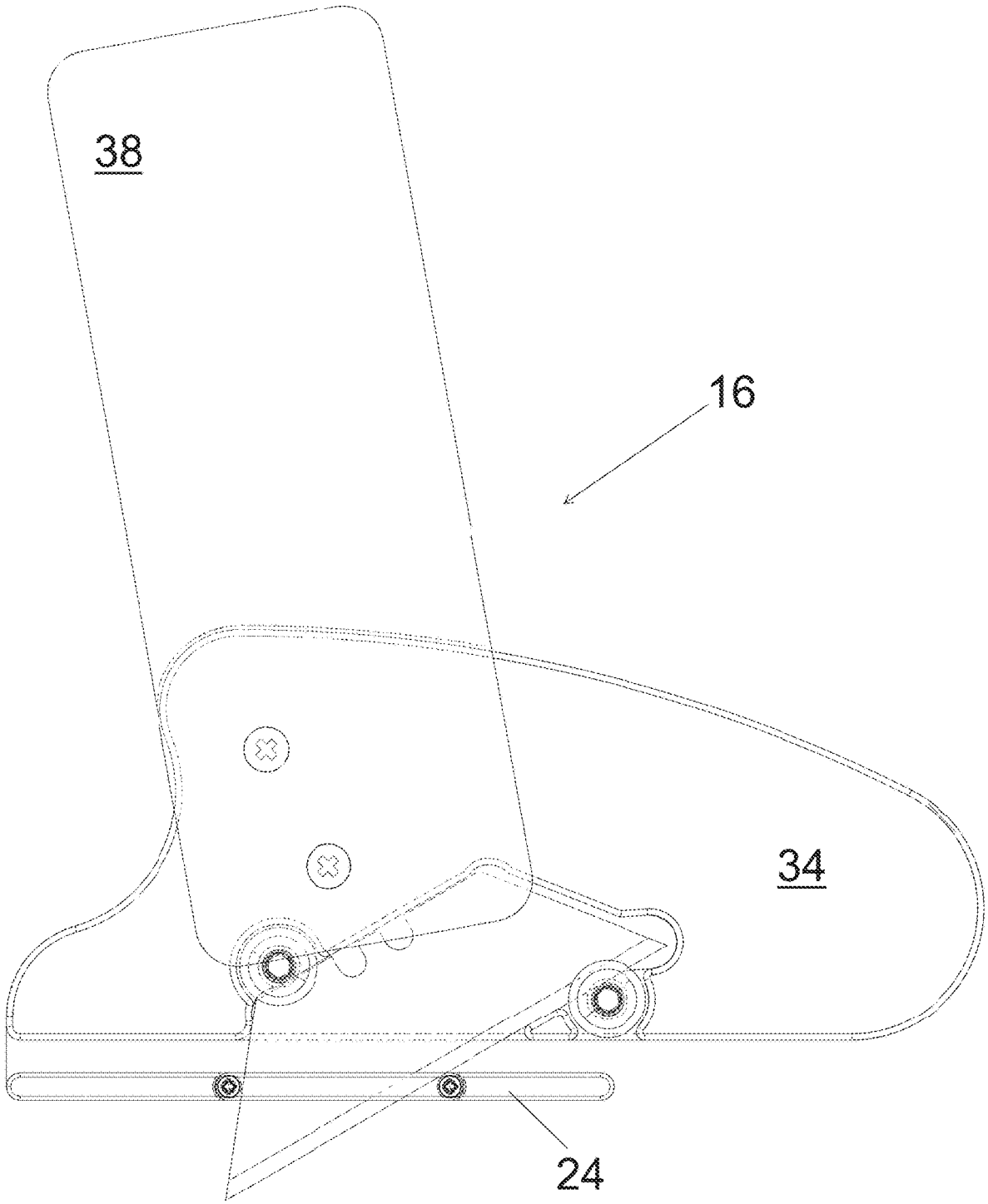
FIG. 27 shows a view from the right of a manual through-cutter (transparent).
Figure 28:
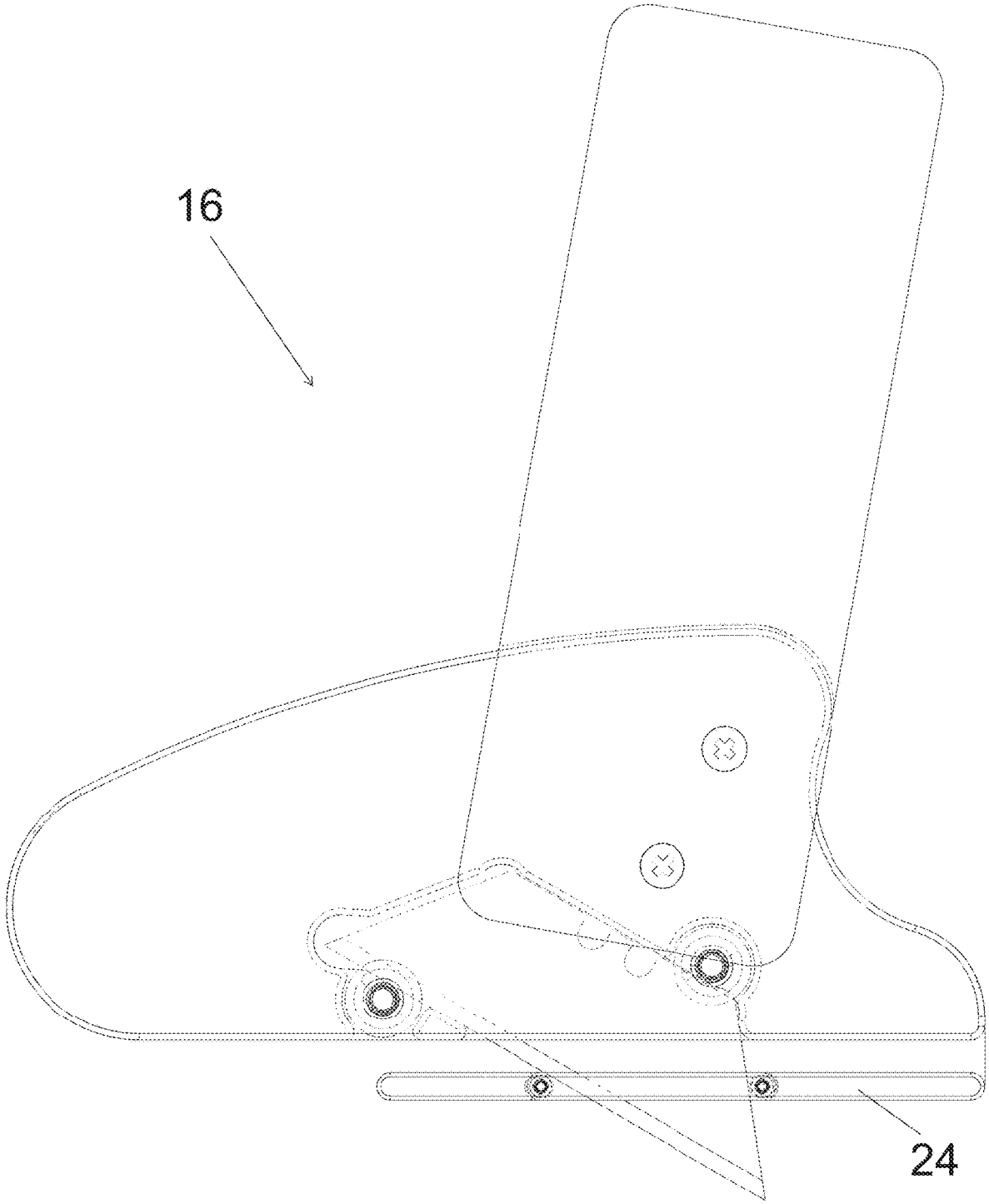
FIG. 28 shows a view from the left of a manual through-cutter (transparent).
Figure 29:
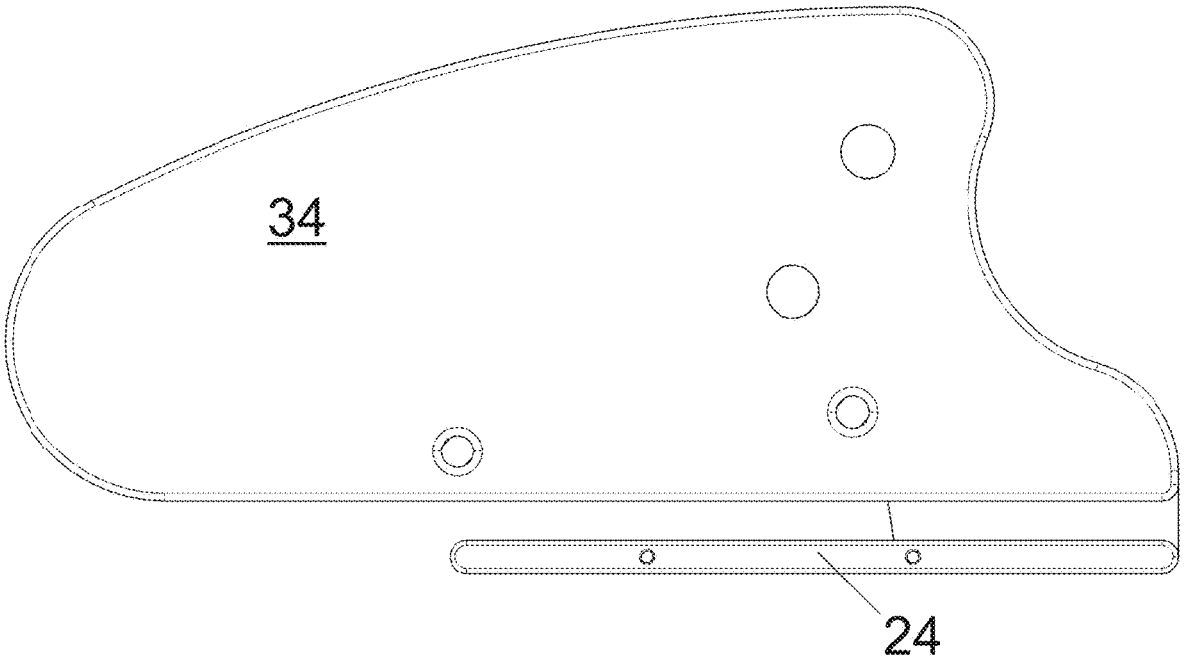
FIG. 29 shows a view from the left of a cutter body of a manual through-cutter.
Figure 30:
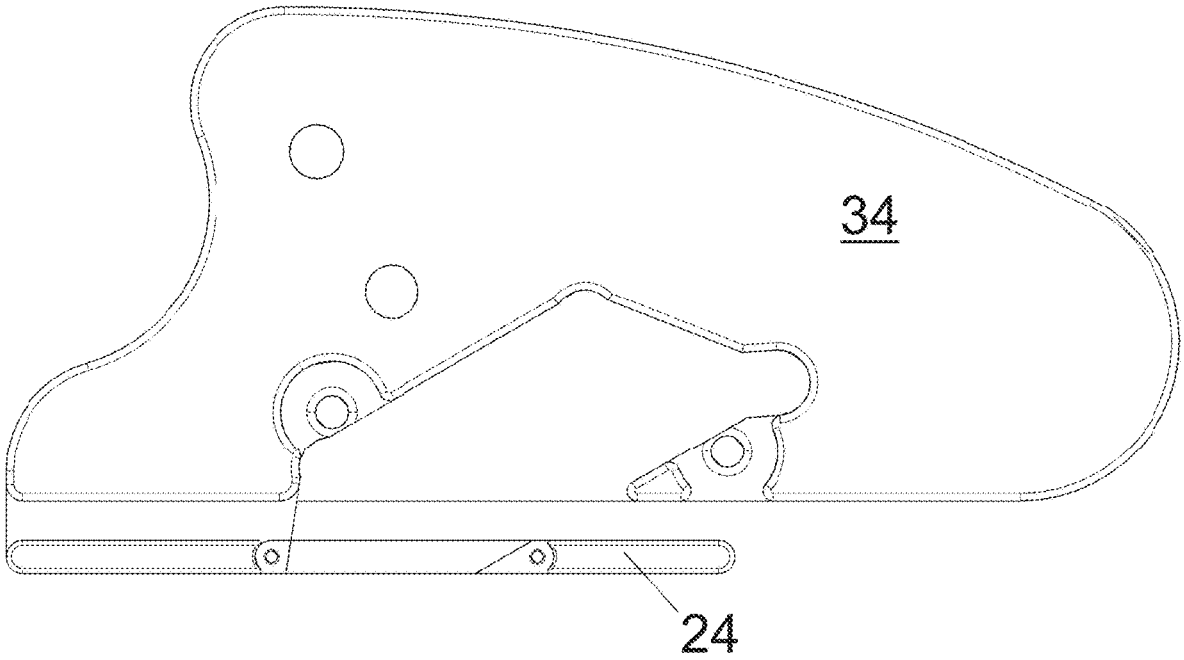
FIG. 30 shows a view from the right of a cutter body of a manual through-cutter.
Figure 31:
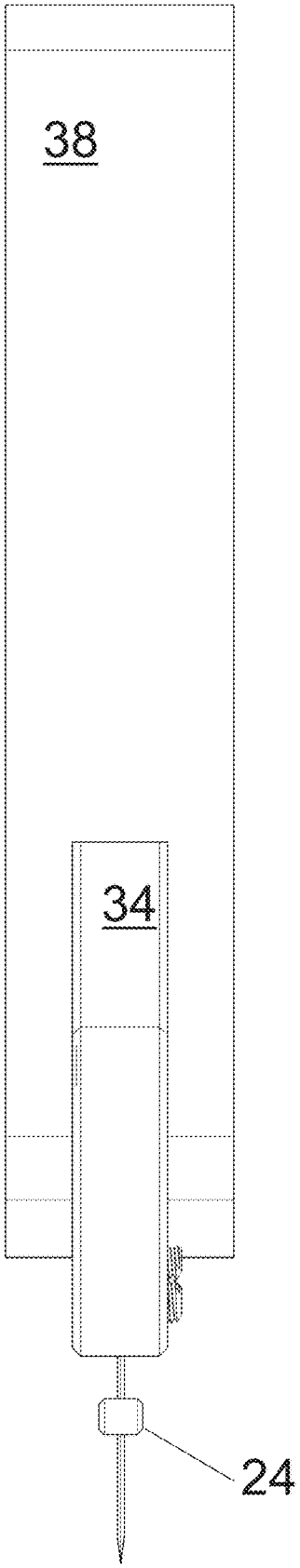
FIG. 31 shows a view from the front of a cutter body of a manual through-cutter.
Figure 32:
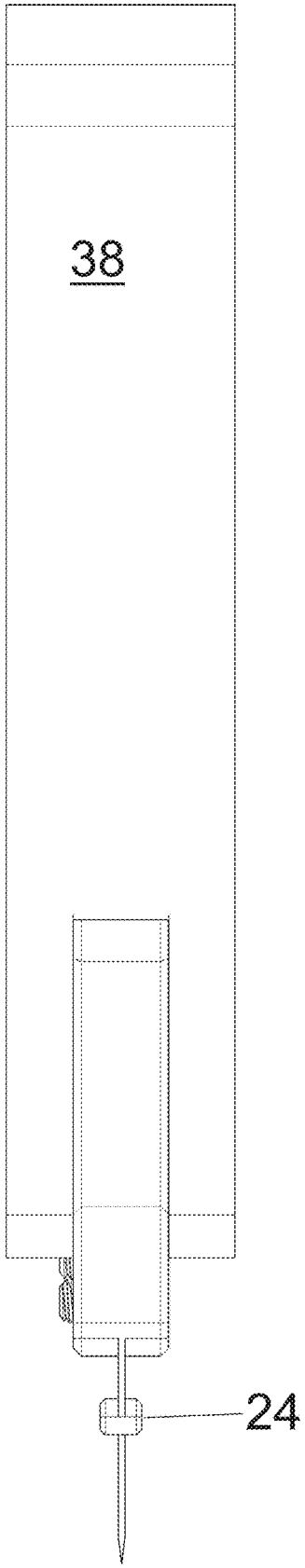
FIG. 32 shows a view from the rear of a cutter body of a manual through-cutter.
Figure 33:
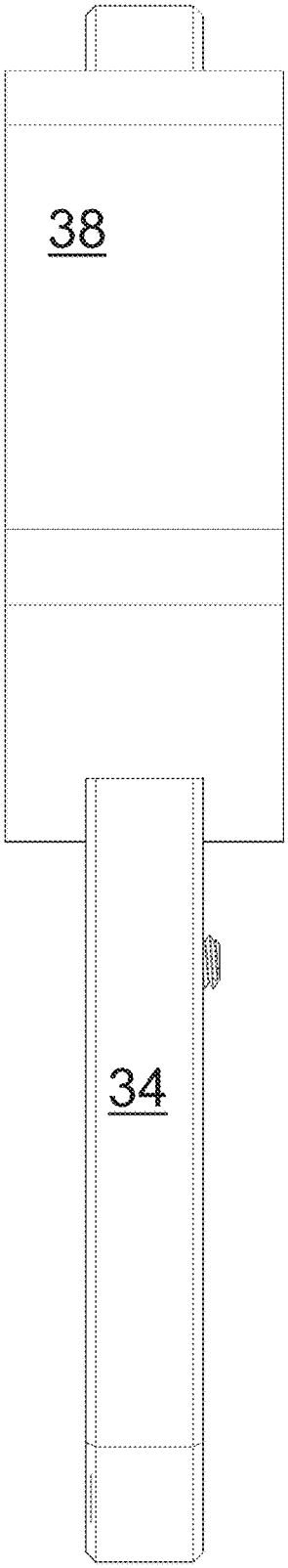
FIG. 33 shows a view from above of a cutter body of a manual through-cutter.
Figure 34:
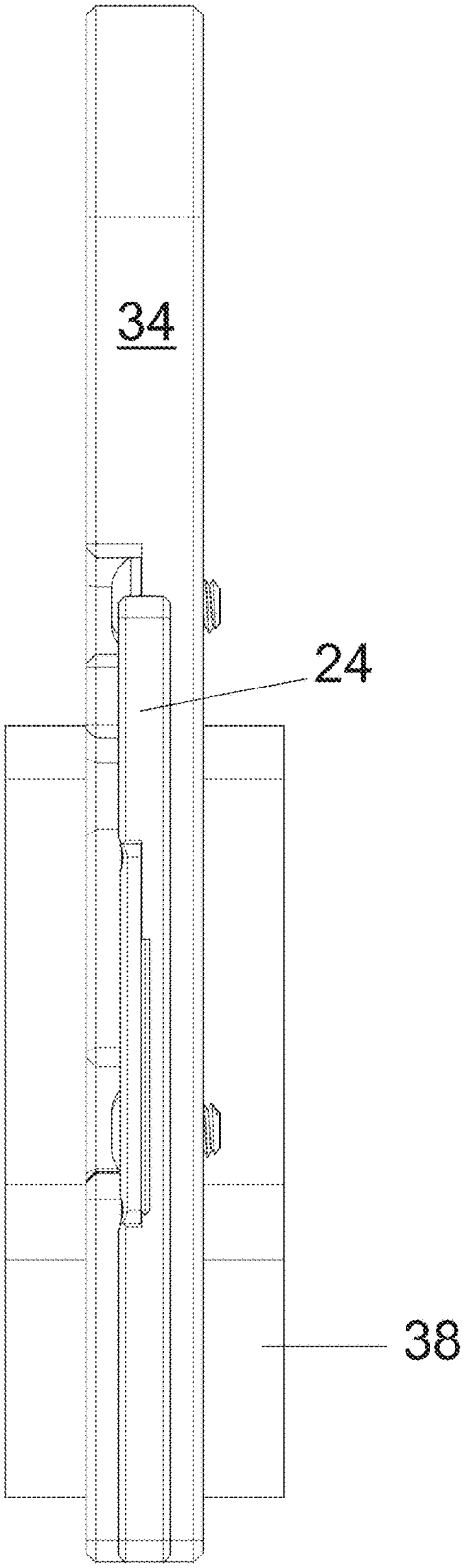
FIG. 34 shows a view from below of a cutter body of a manual through-cutter.
Figure 35:
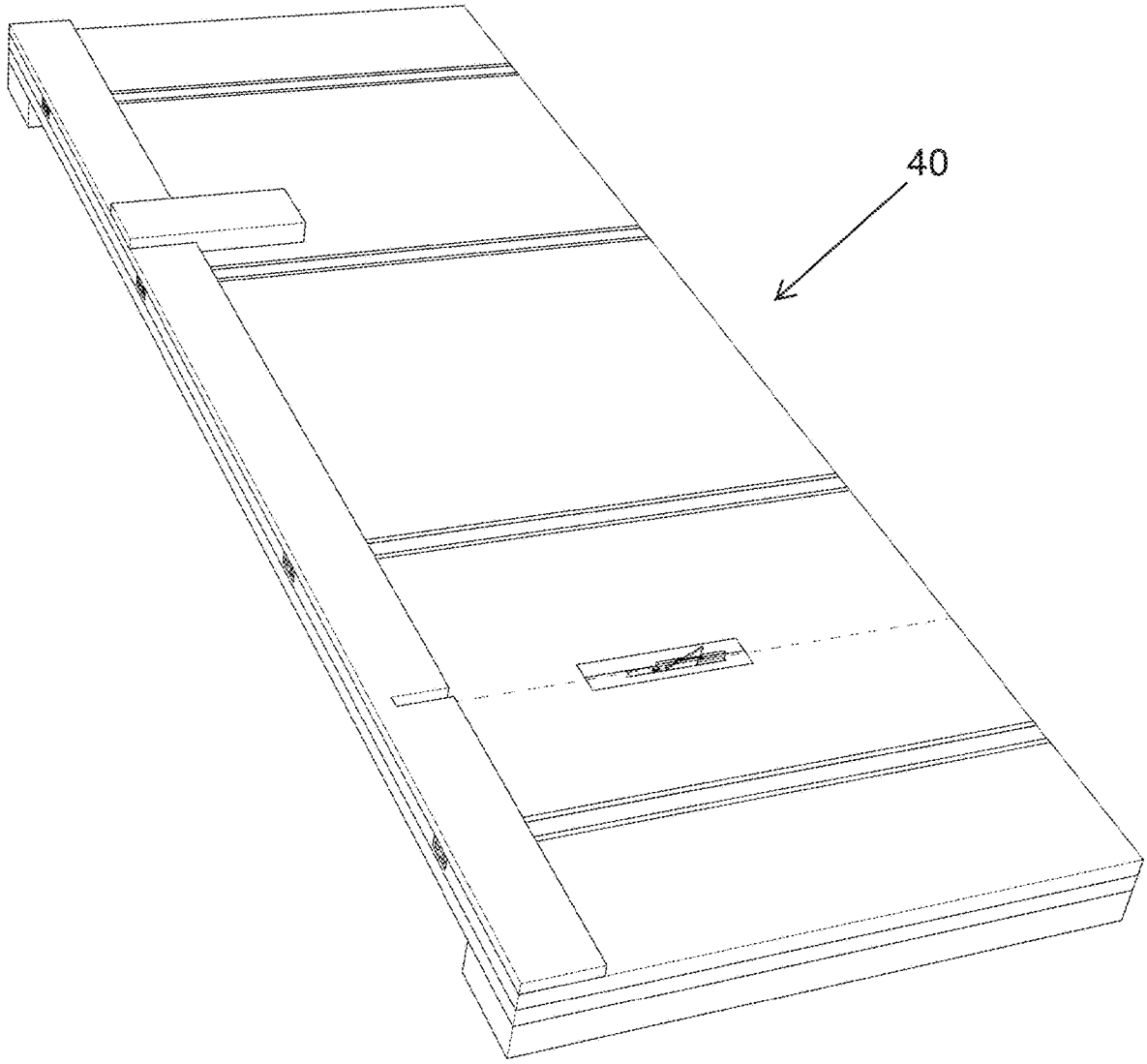
FIG. 35 shows a perspective view of a blade-in-table, moving workpiece type through-cutter tool. A blade-in-table, moving workpiece type defluting cutter would be conceptually similar (except, of course, it would have 2 blades, etc., as shown in FIG. 38).
Figure 36:
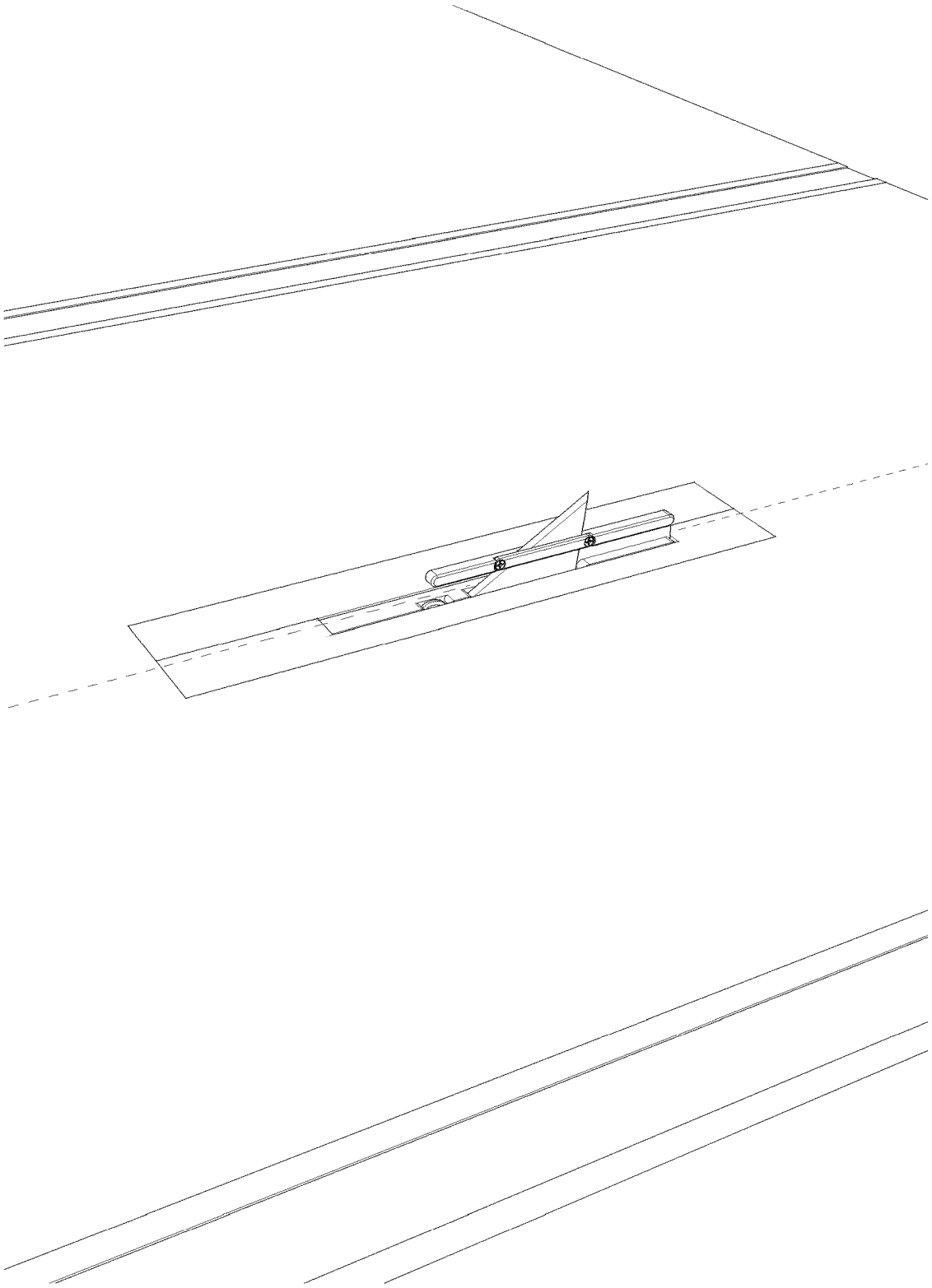
FIG. 36 shows a closer perspective view of a blade portion of a blade-in-table, moving workpiece type through-cutter tool, with guide prong, and exposed blade, above table. A blade-in-table, moving workpiece type defluting cutter would be conceptually similar (except, of course, it would have 2 blades, etc., as shown in FIG. 38).

Embodiments of the inventive technology may be described as a method for reconfiguring a foam fluted board (e.g., removing material of said board) that includes the steps of: removing, from the foam fluted board, at least a portion of the ceiling (or floor) of at least one of the channels of the fluted board core of said foam fluted board, to generate at least one removed ceiling or floor; and removing, from the foam fluted board, at least some of said upper (or lower) foam layer that is between the at least one removed ceiling (or floor) and the outer surface of said foam fluted board that is closest to the at least one removed ceiling (or floor). Upon performing such steps, a valley, as shown in, e.g., FIG. 7, may be exposed (note that the board is not separated along that valley's bottom, and that the board can be bent more easily along the long axis of the valley, with both sides of the board along that axis brought together in angular direction towards the valley during the bending process). The removal steps may, but need not, be performed simultaneously (e.g., as when a defluting cutter is used). Note that any of a variety of tools may be used to achieve the steps of removing including but not limited to: grinder, rotating abrasive belt, spinning stone, belt sander, and a spinning bit tool. All tools may be either moving blade (or generally, moving tool), or moving workpiece type.

Figure 37:
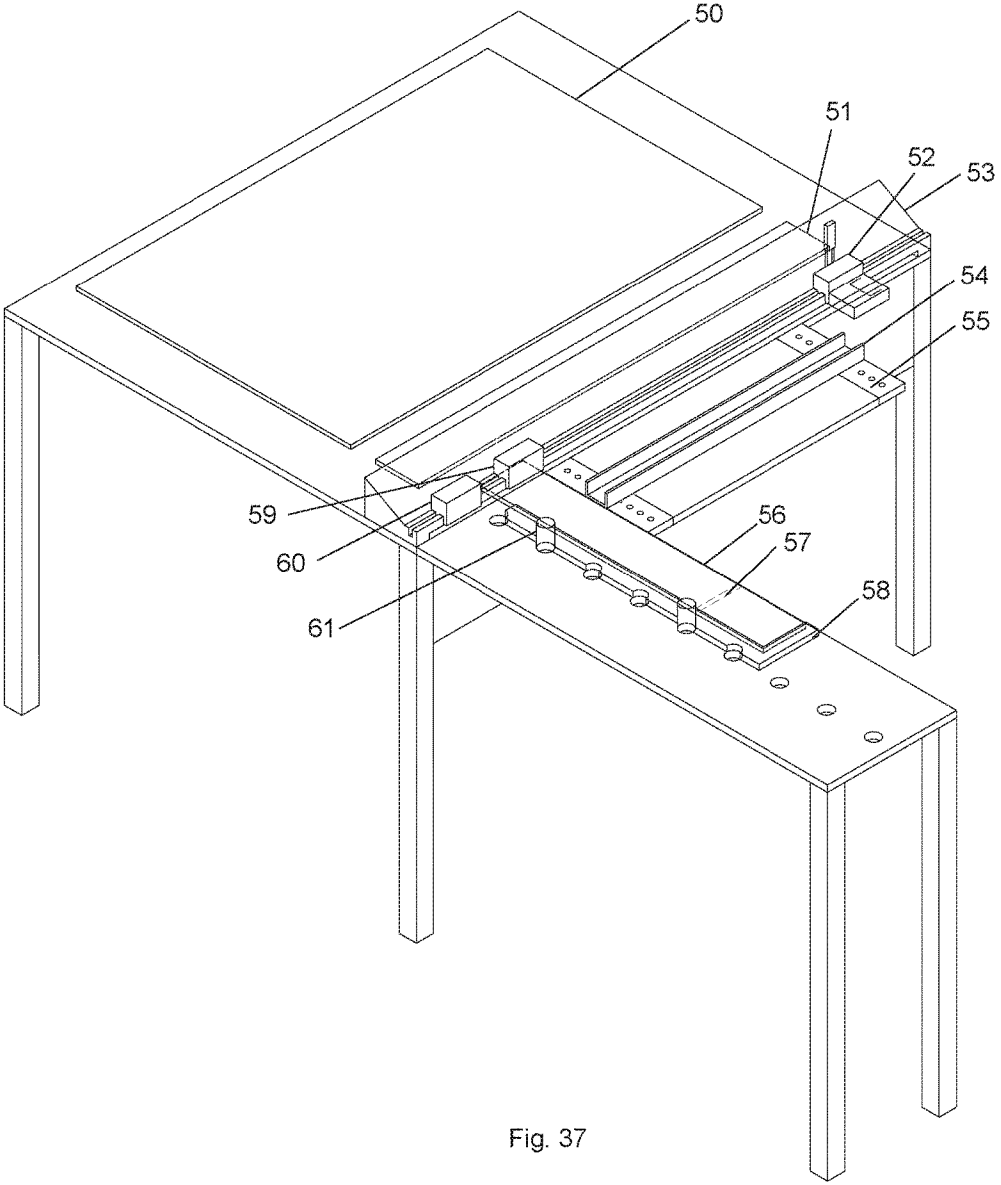
FIG. 37 shows a view of an embodiment of an all purpose cutter. It shows a guided, manual, moving blade tool that can act as a through-cutter tool or a defluting cutter tool. It shows a through-cutting head and a defluting cutting head established for sliding along the same track, in addition to guides such as stops, templates, and fencing. In particular embodiments, cutters as described elsewhere herein, but perhaps without handles, may be established in and as part of the cutting heads.
Figure 38:
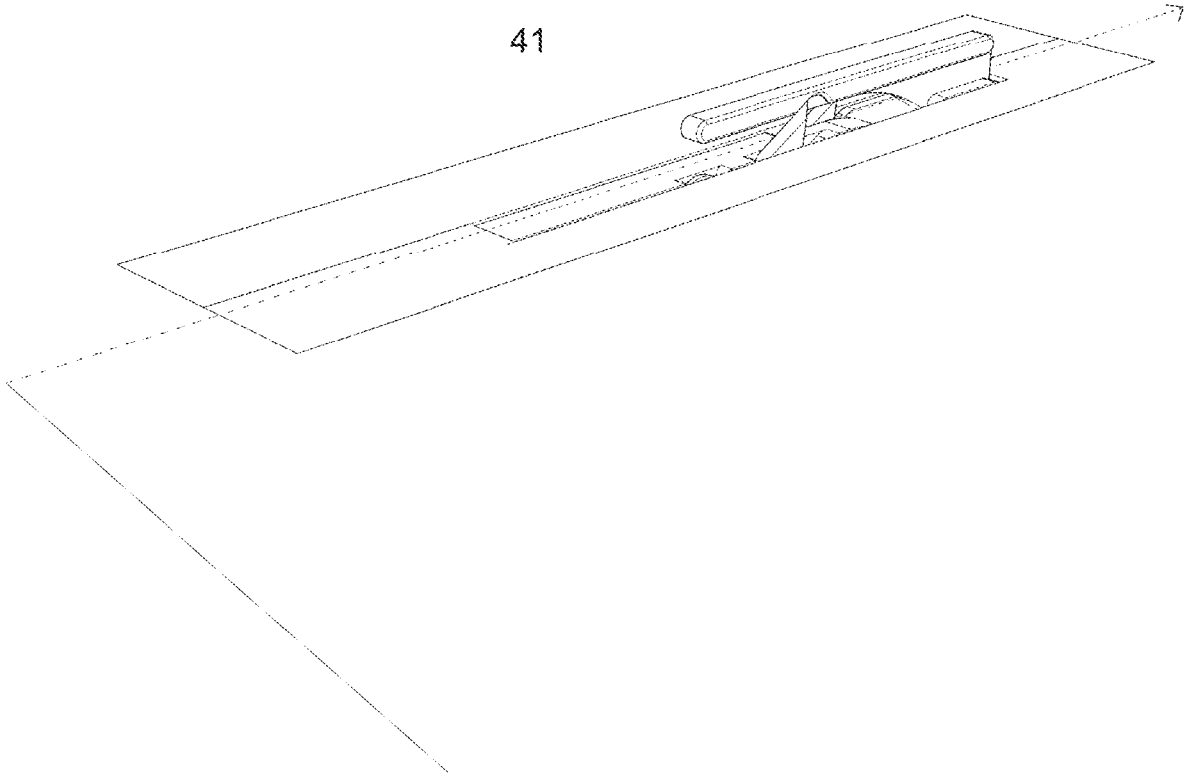
FIG. 38 shows a perspective view of a defluter as may appear in a blade-in-table, moving workpiece type defluting cutter. For clarity, only the defluting cutter of the entire tool is show; components of the entire tool that are not shown would appear, in particular embodiments, as shown in FIG. 35.

FIG. 37 shows an embodiment of an all-purpose cutter that may comprise: uncut sheet of divider material (50), strip cut from sheet (51, 56), cutting head die-cut press lever-activated (52), sliding track (53), height fixture stop block (54), height fixture adjustable for cutting heights of strips (55), deflute cuts achieved through moving of template (57), deflute cut template (58), cutting head thru-cut (59), cutting head deflute cut (60), and registration peg adjustable for various model of insert (61).

As can be easily understood from the foregoing, the basic concepts of the present invention may be embodied in a variety of ways. It involves both cutting techniques as well as devices to accomplish the appropriate cut. In this application, the cutting techniques are disclosed as part of the results shown to be achieved by the various devices described and as steps which are inherent to utilization. They are simply the natural result of utilizing the devices as intended and described. In addition, while some devices are disclosed, it should be understood that these not only accomplish certain methods but also can be varied in a number of ways. Importantly, as to all of the foregoing, all of these facets should be understood to be encompassed by this disclosure.

The discussion included in this nonprovisional application is intended to serve as a basic description. The reader should be aware that the specific discussion may not explicitly describe all embodiments possible; many alternatives are implicit. It also may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function. Apparatus claims may not only be included for the device described, but also method or process claims may be included to address the functions the invention and each element performs. Neither the description nor the terminology is intended to limit the scope of the claims that will be included in any subsequent patent application.

It should also be understood that a variety of changes may be made without departing from the essence of the invention. Such changes are also implicitly included in the description. They still fall within the scope of this invention. A broad disclosure encompassing both the explicit embodiment(s) shown, the great variety of implicit alternative embodiments, and the broad methods or processes and the like are encompassed by this disclosure and may be relied upon when drafting the claims for any subsequent patent application. It should be understood that such language changes and broader or more detailed claiming may be accomplished at a later date (such as by any required deadline) or in the event the applicant subsequently seeks a patent filing based on this filing. With this understanding, the reader should be aware that this disclosure is to be understood to support any subsequently filed patent application that may seek examination of as broad a base of claims as deemed within the applicant's right and may be designed to yield a patent covering numerous aspects of the invention both independently and as an overall system.

Further, each of the various elements of the invention and claims may also be achieved in a variety of manners. Additionally, when used or implied, an element is to be understood as encompassing individual as well as plural structures that may or may not be physically connected. This disclosure should be understood to encompass each such variation, be it a variation of an embodiment of any apparatus embodiment, a method or process embodiment, or even merely a variation of any element of these. Particularly, it should be understood that as the disclosure relates to elements of the invention, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled. As but one example, it should be understood that all actions may be expressed as a means for taking that action or as an element which causes that action. Similarly, each physical element disclosed should be understood to encompass a disclosure of the action which that physical element facilitates. Regarding this last aspect, as but one example, the disclosure of a "cut" should be understood to encompass disclosure of the act of "cutting"—whether explicitly discussed or not—and, conversely, were there effectively disclosure of the act of "cutting", such a disclosure should be understood to encompass disclosure of a "cut" and even a "means for cutting" Such changes and alternative terms are to be understood to be explicitly included in the description. Further, each such means (whether explicitly so described or not) should be understood as encompassing all elements that can perform the given function, and all descriptions of elements that perform a described function should be understood as a non-limiting example of means for performing that function.

Any patents, publications, or other references mentioned in this application for patent are hereby incorporated by reference. Any priority case(s) claimed by this application is hereby appended and hereby incorporated by reference. In addition, as to each term used it should be understood that unless its utilization in this application is inconsistent with a broadly supporting interpretation, common dictionary definitions should be understood as incorporated for each term and all definitions, alternative terms, and synonyms such as contained in the Random House Webster's Unabridged Dictionary, second edition are hereby incorporated by reference. Finally, all references listed in the list of References To Be Incorporated By Reference In Accordance With The Provisional patent Application or other information statement filed with the application are hereby appended and hereby incorporated by reference, however, as to each of the above, to the extent that such information or statements incorporated by reference might be considered inconsistent with the patenting of this/these invention(s) such statements are expressly not to be considered as made by the applicant(s).

Thus, the applicant(s) should be understood to have support to claim and make a statement of invention to at least: i) each of the cutting devices as herein disclosed and described, ii) the related methods disclosed and described, iii) similar, equivalent, and even implicit variations of each of these devices and methods, iv) those alternative designs which accomplish each of the functions shown as are disclosed and described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) each system, method, and element shown or described as now applied to any specific field or devices mentioned, x) methods and apparatuses substantially as described hereinbefore and with reference to any of the accompanying examples, xi) an apparatus for performing the methods described herein comprising means for performing the steps, xii) the various combinations and permutations of each of the elements disclosed, xiii) each potentially dependent claim or concept as a dependency on each and every one of the independent claims or concepts presented, and xiv) all inventions described herein.

With regard to claims whether now or later presented for examination, it should be understood that for practical reasons and so as to avoid great expansion of the examination burden, the applicant may at any time present only initial claims or perhaps only initial claims with only initial dependencies. The office and any third persons interested in potential scope of this or subsequent applications should understand that broader claims may be presented at a later date in this case, in a case claiming the benefit of this case, or in any continuation in spite of any preliminary amendments, other amendments, claim language, or arguments presented, thus throughout the pendency of any case there is no intention to disclaim or surrender any potential subject matter. It should be understood that if or when broader claims are presented, such may require that any relevant prior art that may have been considered at any prior time may need to be re-visited since it is possible that to the extent any amendments, claim language, or arguments presented in this or any subsequent application are considered as made to avoid such prior art, such reasons may be eliminated by later presented claims or the like. Both the examiner and any person otherwise interested in existing or later potential coverage, or considering if there has at any time been any possibility of an indication of disclaimer or surrender of potential coverage, should be aware that no such surrender or disclaimer is ever intended or ever exists in this or any subsequent application. Limitations such as arose in *Hakim v. Cannon Avent Group, PLC,* 479 F.3d 1313 (Fed. Cir 2007), or the like are expressly not intended in this or any subsequent related matter. In addition, support should be understood to exist to the degree required under new matter laws—including but not limited to European Patent Convention Article 123(2) and United States Patent Law 35 USC 132 or other such laws—to permit the addition of any of the various dependencies or other elements presented under one independent claim or concept as dependencies or elements under any other independent claim or concept. In drafting any claims at any time whether in this application or in any subsequent application, it should also be understood that the applicant has intended to capture as full and broad a scope of coverage as legally available. To the extent that insubstantial substitutes are made, to the extent that the applicant did not in fact draft any claim so as to literally encompass any particular embodiment, and to the extent otherwise applicable, the applicant should not be understood to have in any way intended to or actually relinquished such coverage as the applicant simply may not have been able to anticipate all eventualities; one skilled in the art, should not be reasonably expected to have drafted a claim that would have literally encompassed such alternative embodiments.

Further, if or when used, the use of the transitional phrase "comprising" is used to maintain the "open-end" claims herein, according to traditional claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible. The use of the phrase, "or any other claim" is used to provide support for any claim to be dependent on any other claim, such as another dependent claim, another independent claim, a previously listed claim, a subsequently listed claim, and the like. As one clarifying example, if a claim were dependent "on claim 20 or any other claim" or the like, it could be re-drafted as dependent on claim 1, claim 15, or even claim 25 (if such were to exist) if desired and still fall with the disclosure. It should be understood that this phrase also provides support for any combination of elements in the claims and even incorporates any desired proper antecedent basis for certain claim combinations such as with combinations of method, apparatus, process, and the like claims.

Finally, any claims set forth at any time are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

What is claimed is:

1. A cutter apparatus usable to reconfigure multi-layer, foam fluted board so said multi-layer, foam fluted board, upon reconfiguration, is usable as divider material in a storage container, said multi-layer, foam fluted board having a corrugated core layer sandwiched by upper and foam layers, said cutter apparatus comprising:

a guide prong insertable into a flute of said corrugated core layer;

a central vertical plane that divides said cutter apparatus into a right cutter portion and a left cutter portion, said cutter apparatus having a front-most portion;

a first blade to a right of said central vertical plane; and a second blade to a left of said central vertical plane;

wherein said first and second blades each angle upwards and towards a front of said cutter apparatus, and wherein one of said first and second blades is closer to said front-most portion of said cutter apparatus than is the other of said first and second blades, said cutter apparatus further comprising:

a cutter body to which said first and second blades are removably secured;

a handle established above said first and second blades, said handle having a handle longitudinal axis; and a removed material ejection ramp established through said cutter body and rearward of said first and second blades, and having a rearward half that is rearward of at least a portion of said handle longitudinal axis and that projects substantially above said foam fluted board at an angle behind a location at which said foam fluted board is cut that is configured to divert removed material upward above said foam fluted board behind the cutter.

2. A cutter apparatus as described in claim 1 and further comprising a first prong recess on a right side of said prong configured to accept a trailing portion of said first blade.

3. A cutter apparatus as described in claim 1 and further comprising a second prong recess on a left side of said prong configured to accept a trailing part of said second blade.

4. A cutter apparatus as described in claim 1 wherein said cutter apparatus is configured and arranged to remove a strip of material from said multi-layer, foam fluted board to create a valley in said board.

5. A cutter apparatus as described in claim 1 wherein said handle longitudinal axis is upwards and rearwards at an angle with horizontal between 70° and 90°.

6. A cutter apparatus usable to reconfigure multi-layer, foam fluted board so it is usable as divider material in a storage container, said multi-layer, foam fluted board having a corrugated core layer that includes flutes and that is sandwiched by a foam layer on each of both sides of said core, said cutter apparatus having a right side, a left side, and a front-most portion, and comprising:

a guide prong insertable into DA any one of said flutes of said corrugated core layer;

a first blade on said right side of said cutter apparatus;

a second blade on said left side of said cutter apparatus; and a cutter body to which said first and second blades are removably secured;

wherein one of said first and second blades is closer to said front-most portion of said cutter apparatus than is the other of said first and second blades;

said cutter apparatus further comprising:

a handle established at an upper portion of said cutter apparatus; and a removed material ejection ramp established through said cutter body and rearward of said first and second blades so that, during use of said cutter apparatus, material removed by said cutter apparatus is diverted upward and behind said cutter apparatus and that projects substantially above said foam fluted board at an angle behind a location at which said foam fluted board is cut that is configured to divert removed material upward above said foam fluted board behind the cutter.

7. A cutter apparatus usable to reconfigure fluted board so it is usable as divider material in a storage container, said cutter apparatus comprising:

a guide prong insertable into a flute of said fluted board;

a central vertical plane that divides said cutter apparatus into a right cutter portion and a left cutter portion; and at least one blade having an exposed portion in position to cut at least a portion of said sandwiched board, wherein said at least one blade angles upwards and towards a front of said cutter apparatus, said cutter apparatus further comprising:

a cutter body to which said at least one blade is removably secured;

a handle established substantially above said at least one blade; and a removed material ejection ramp that is established rearward of said blade and that projects substantially above said fluted board at an angle behind a location at which said fluted board is cut that is capable of diverting removed material upward above said fluted board behind the cutter apparatus.

8. A cutter apparatus as described in claim 7 wherein said handle has a longitudinal axis that is upwards and rearwards at an angle with horizontal between 70° and 90°.

9. A cutter apparatus as described in claim 7 wherein said cutter apparatus comprises a through-cutter.

10. A cutter apparatus as described in claim 7 wherein said cutter apparatus comprises a defluter cutter.

11. A cutter apparatus as described in claim 10 wherein said cutter apparatus is usable to remove a strip of material from said fluted board.

12. A cutter apparatus as described in claim 10 wherein said at least one blade comprises two blades.

13. A cutter apparatus as described in claim 12 wherein said handle has a handle longitudinal axis and said apparatus further comprises a removed material ejection ramp that is established rearward of said blades and of said handle longitudinal axis.

14. A cutter apparatus as described in claim 7 wherein said fluted board is multi-layer, foam fluted board configured and arranged as said divider material in a storage container, said multi-layer, foam fluted board having a corrugated core layer sandwiched by a foam layer on each of both sides of said core.

15. A cutter apparatus as described in claim 1 wherein a rearward half of said removed material ejection ramp has an average angle relative to horizontal between 10° and 50°.

16. A cutter apparatus as described in claim 1 wherein said handle is established directly above said first and second blades.

17. A cutter apparatus as described in claim 6 wherein said first and second blades each angle upwards and towards said front-most portion of said cutter apparatus.

18. A cutter apparatus as described in claim 6 wherein said handle has a handle longitudinal axis and a rearward half of said removed material ejection ramp is established rearward of at least a portion of said handle longitudinal axis.

* * * * *